US010773874B2

(12) United States Patent
Gundersen

(10) Patent No.: US 10,773,874 B2
(45) Date of Patent: Sep. 15, 2020

(54) DOSAGE DEVICE

(71) Applicant: FIMtech AS, Vear (NO)

(72) Inventor: Dag H. Gundersen, Tolvsrød (NO)

(73) Assignee: FIMTECH AS, Vear (NO)

( * ) Notice: Subject to any disclaimer, the term of this patent is extended or adjusted under 35 U.S.C. 154(b) by 0 days.

(21) Appl. No.: 15/522,952

(22) PCT Filed: Oct. 16, 2015

(86) PCT No.: PCT/IB2015/057967
§ 371 (c)(1),
(2) Date: Apr. 28, 2017

(87) PCT Pub. No.: WO2016/071786
PCT Pub. Date: May 12, 2016

(65) Prior Publication Data

US 2017/0313494 A1 Nov. 2, 2017

(30) Foreign Application Priority Data

Nov. 7, 2014 (NO) ..... 20141330

(51) Int. Cl.
*B65D 83/00* (2006.01)
*B65D 83/06* (2006.01)
(Continued)

(52) U.S. Cl.
CPC ..... *B65D 83/0055* (2013.01); *B65D 47/2018* (2013.01); *B65D 47/2031* (2013.01);
(Continued)

(58) Field of Classification Search
CPC ..... B65D 83/0055; B65D 47/2031; B65D 83/06; B65D 75/008; B65D 75/5805;
(Continued)

(56) References Cited

U.S. PATENT DOCUMENTS 3,191,820 A * 6/1965 Kuster ..... B65D 47/2037 222/490
3,595,446 A * 7/1971 Hellstrom ..... B65D 47/2031 206/540
(Continued)

FOREIGN PATENT DOCUMENTS

CN 101920794 12/2010
CN 201932453 8/2011
(Continued)

OTHER PUBLICATIONS

International Search Report dated Jan. 8, 2016 in International (PCT) Application No. PCT/IB2015/057967.
(Continued)

*Primary Examiner* — David P Angwin
*Assistant Examiner* — Bob Zadeh
(74) *Attorney, Agent, or Firm* — Wenderoth, Lind & Ponack, L.L.P.

(57) ABSTRACT

A flexible package is designed to contain a product, for instance a spice or a cosmetic product, and the flexible package is formed of at least two layers of flexible material joined together to create a closed package (volume). A dosage device is arranged on an inner face of the closed package, and the dosage device includes an elastic dosage membrane having a number of incisions over at least a part of its width and length, and includes an opening device configured to stretch the elastic dosage membrane.

21 Claims, 9 Drawing Sheets

(51) Int. Cl.
*B65D 47/20* (2006.01)
*B65D 75/00* (2006.01)
*B65D 75/58* (2006.01)

(52) U.S. Cl.
CPC ..... *B65D 75/008* (2013.01); *B65D 75/5805* (2013.01); *B65D 83/06* (2013.01)

(58) Field of Classification Search
CPC .. B65D 1/32; B65D 2583/00; B65D 47/2018; B65D 47/2037; B65D 75/58; B65D 75/5811; B65D 75/5822; B65D 75/5866
See application file for complete search history.

(56) References Cited

U.S. PATENT DOCUMENTS 3,628,707 A * 12/1971 Hieke ..... B65D 5/72 222/567
4,553,971 A * 11/1985 Ashley ..... B65D 33/00 222/107
4,592,493 A * 6/1986 Smith ..... B65D 47/2031 222/212
4,830,205 A * 5/1989 Hammond ..... A61J 9/005 215/11.1
4,890,744 A * 1/1990 Lane, Jr. ..... B65D 75/5822 206/484
4,974,732 A * 12/1990 Sullivan ..... B65D 75/008 206/484
5,709,479 A 1/1998 Bell
6,126,318 A * 10/2000 Bell ..... B65D 75/008 222/105
2004/0045922 A1 3/2004 Holley, Jr.
2004/0129800 A1* 7/2004 Duquet ..... B65D 75/58 239/327
2004/0188461 A1* 9/2004 Pennaneac'h ..... A45D 34/02 222/103
2005/0084186 A1* 4/2005 Caris ..... B65D 75/5838 383/203
2007/0110856 A1* 5/2007 Kanzaki ..... B65D 77/225 426/107
2011/0211776 A1* 9/2011 Conforti ..... B65D 33/24 383/43
2013/0292414 A1* 11/2013 Sutherland ..... B65D 35/10 222/107
2014/0314342 A1 10/2014 Verma
2017/0313494 A1* 11/2017 Gundersen ..... B65D 83/0055

FOREIGN PATENT DOCUMENTS

CN 103328337 9/2013
FR 2 588 835 4/1987
FR 2588835 * 4/1987 ..... B65D 47/2031
JP 10-81347 3/1998
JP 2004-256120 9/2004
JP 2004256120 * 9/2004
JP 2005-178068 7/2005
JP 2005-255201 9/2005
JP 2005-280767 10/2005
JP 2006-193173 7/2006
JP 2010-120686 6/2010
JP 2012-184021 9/2012
JP 2012-529406 11/2012
WO 2008/034168 3/2008
WO 2009/056819 5/2009

OTHER PUBLICATIONS

Search Report dated Jun. 5, 2015 in Norwegian Application No. 20141330.
English translation of Search Report dated Jul. 10, 2018 in Chinese Application No. 201580072638.9.
Office Action dated Sep. 18, 2019 in corresponding Japanese Patent Application No. 2017-542368, with English translation.

* cited by examiner

DOSAGE DEVICE

BACKGROUND OF THE INVENTION

The present invention concerns a package manufactured from a flexible material, specifically for grainy/granular or powdery products. More specifically, the present invention concerns a package of a flexible material which is provided with at least a device which allows easy and controlled dosage and/or delivery of the product contained in the package, and which automatically will close after use.

Presently, there exist a number of package forms for storage of different grainy, granular, or powdery products. Examples of such products may be ground spices, such as salt, pepper, cinnamon, or the like, or granular spices in the form of finely chopped spicy herbs (e.g., oregano). Other examples of such products may be different medical powders for application at wound areas (e.g., talcum), or different cosmetic powders, such as for instance face powder.

Package forms for these products are often glass/rigid plastic containers, or more thin-walled and flexible packages.

Flexible packages are commonly characterized by being produced from different materials from a roll, which are shaped into containers such as simple bags (sachets, pouches), tube shaped bags (so-called flow packs/stick packs), or independently standing bags/standing pouches. The materials used in such flexible packages are generally different laminates of plastic, paper and/or barrier films, which together confer the necessary strength and storage properties (e.g., maintenance of aroma) to the flexible package. The materials are formed into containers or packages, and are joined along defined areas using techniques such as for instance gluing or welding (heat, ultra sound, laser, etc.). Today, there exist a lot of techniques enabling the production of thin-walled, tube shaped bags employing for instance injection molding, wherein the tube shaped bags may be used as a component in a flexible package (e.g., tooth paste tubes, milk packages etc.).

The rigid glass/plastic containers are generally equipped with different lids; and in some cases simple devices for dosage and pouring of the products.

The flexible packages for storing granular or powdery products are often completely closed packages which may be opened by tearing along defined package edges, or by using scissors/knives. After use, the opening edge is folded together and is held together with a rubber band, clips, etc.

However, presently, closable packages in which the flexible package is closed after use, using for instance a built-in zip-lock, are becoming more common. EP 2050688 A1 discloses an independently standing package of a flexible material for a granular or powdery product, wherein the package comprises a supporting base area, from which base area opposite side walls extend. The side walls are connected to the periphery of the base area, and the side edges are further connected to each other up to a certain height of the package such that free upper areas of the side walls are left, and a perforated plate, along its circumference, is fixed to an inner side of the free upper areas of the side edges. Before the package has been opened, the perforated plate is folded together and connected around its circumference. When the package is to be used, the perforated plate is torn apart to provide an opening in the package.

However, the known flexible packages provide the user with little possibility to control the pouring of the product contained in the package, because pouring of the product occurs through predefined openings in the package. In addition, the user has to close the package after use, using for example rubber bands, paper clips, or zip-locks, which may cause the user to forget closing the package and/or not closing the package completely or in a correct way, in which case the product may loose aroma and/or taste.

Thus, it is an object of the present invention to provide a flexible package which contains and pours out a product, which package is provided to enable a controlled dosage and/or pouring of the product, wherein the package will close automatically after use.

It is a further object of the present invention to provide a flexible package which is economically and easy to manufacture.

SUMMARY OF THE INVENTION

The above objects are achieved with a flexible package according to the invention.

According to the present invention, a package of a flexible material is provided, which package is designed to hold a product and is joined together to form a closed package. At an inner face of the closed package, a dosage device for the flexible package is arranged, which dosage device comprises an elastic dosage membrane, and the elastic dosage membrane is provided with a number of through-going or partially through-going incisions over at least part of its length and width.

In an embodiment, the dosage device may further comprise at least an opening device, which for instance may be constituted by two or more expansion plates and/or at least a closing device which for instance may be constituted by two or more closing plates. The function of the expansion plates is to stretch the elastic dosage membrane such that the through-going or partially through-going incisions are expanded/stretched into openings. The size of the openings are dependent on which mechanical load the expansion plates are subjected to. The function of the closing plates is to seal the opening in the flexible package after use, such that for instance aroma from the product contained in the flexible package escapes to the smallest possible degree.

However, it could be envisaged that the materials used in the production of the package may have properties which provide an opening device and/or closing device in the material itself, in which case the material will be such that it may be considered functioning as expansion and/or closing plates. If the package is produced through injection molding, one may through the injection molding provide a material with varying thickness, whereby, by forming the material thicker in one area, may be able to obtain the properties which are achieved with the expansion and/or closing plates.

A mechanical load is, according to the present invention, to be interpreted as an external influence on the expansion plates by a user, either in a longitudinal and/or transversal direction of the expansion plates, for such to change the shape of the expansion plates to a lesser or higher degree under the mechanical load. After changing, the expansion plates will return to their initial shape when the mechanical load discontinues.

The flexible package according to the present invention may, for example, be used to store different grainy, granular, or powdery products, such as spices, a medical powder, a cosmetic powder, or the like.

The manufacturing of the flexible package itself may be provided in a number of different ways. The flexible package may, for instance, be manufactured as a common bag, wherein the flexible package then may be constituted by two (or more) separate material layers, which in a suitable way are joined together around the outer edges. The flexible package may also conceivably be manufactured from only one material layer, which is folded about a folding line and then, in a suitable way, joined together along the "open" outer edges to form a closed container. The flexible package may also conceivably be formed from one material layer using longitudinal folding and welding (so-called flow pack), which then is joined at the bottom and top.

A material layer is, according to the present invention, to be understood as being manufactured from one single layer; or the material layer may be constituted of several different or equal materials, which in a suitable way are laminated to form the material layer.

It is also conceivable that the flexible package may be formed as an independently standing bag produced from a material layer. The material layer in the flexible package then will be folded and joined together in such a way that a "bottom" is created in the flexible package, in an opposite end of the dosage device, and makes it possible to arrange the flexible package "standing".

It could also be envisaged that the flexible package may be manufactured in the form of a flexible "pipe", or a flexible tube with longitudinal folding of a package material from a roll, followed by longitudinal welding, or, for instance, by injection molding/extrusion of a suitable plastic material into a thin walled, flexible and closed profile, and both these may be arranged as a "standing" package by mounting in for instance a plastic lid, cap, or the like, in the opposite end of the mounted dosage device.

The package materials constituting the package itself are, if they are made from materials from a roll, often laminates of different plastic, paper, or barrier films which give the package necessary strength and storage properties (for instance to prevent leakage of aroma). For packages made from closed profiles by, for example, injection molding/extrusion, the quality of the plastic materials most often is chosen based on which product the flexible package is intended to contain.

The joining of the layer or layers in the flexible package may for instance be done by gluing or welding with heat, ultra sound, laser, or other similar joining techniques. Consequently, in the following description, the term welding will have the same meaning as for instance joining using glue, or the like.

Even though the dosage device is not described in connection with the above disclosed different embodiments and/or manufacturing of the flexible package, it is to be understood that each and one of the embodiments and/or manufacturing of the flexible package will also comprise such a dosage device, which dosage device will be described in the following.

In order to ease the opening of the flexible package, a weakened tear area or perforated area may be arranged in the vicinity of an end of the flexible package, i.e., outside the area in which the dosage device is mounted, and at a distance from the dosage device. Such a weakened tear area or perforated area may, for example, be provided by embossing the layer(s) of package material, by making non-through-going incisions in the layer(s), for example using laser or corresponding methods known to a person skilled in the art. The flexible package may also be provided without such a weakened tear area or perforated area, whereby in this case a "cutting instruction" will be printed at one or both sides of the flexible package. Such a weakened tear area or perforated area, or "cutting instruction" will run substantially transverse to the longitudinal direction of the flexible package, and will be arranged such that the flexible package is opened when the tear area or perforated area is ripped apart or cut through. On the inside of the tear area or perforated area a zip-lock may also be arranged, for extra security.

A person skilled in the art will understand that the at least one opening device of the dosage device may have resilient or elastic properties. The at least two expansion plates of the opening device may be formed as resilient plates, which, for example, may be manufactured from a thin, but relatively rigid, plastic material. However, the expansion plates may also be formed as articulated plates, which under mechanical load in the form of a applied pressure or tension are moved apart. The expansion plates may also be produced in a different form (than plates), and with other materials such as metal, a "rigid" grid, a number of metal wire, etc. The expansion plates will always cooperate with the dosage membrane, and in an embodiment it is conceivable that the material of the dosage membrane has the necessary resilient and elastic properties to ensure that the forces from the dosage membrane can cause the expansion plates to be pulled together, after the mechanical pressure or tension on the expansion plates ceases.

In order to provide an opening in the flexible package, the opening device may in an embodiment comprise two expansion plates produced from a thin, but relatively rigid, plastic material. The two opposite end parts of the expansion plates (i.e., the ends) in a suitable way are coupled together or connected to each other, for example with heat welding, gluing, or the like, such that some sort of "hinge" is created in one or both ends of the expansion plates. Such a "hinge" function may also be achieved by not having the expansion plates connected, for example through heat welding, gluing, or the like, but are instead held in contact with each other at the ends, because of the joining of the outer edges of the flexible package and/or a weld.

Such a "hinged" design of the expansion plates will cause the expansion plates to abut each other in an "initial position". However, the expansion plates will be pressed or stretched away from each other such that an opening between them is created when a mechanical load is applied against the end parts (the hinged or coupled end parts of the expansion plates are pressed against each other) of the expansion plates. By applying a higher or lower mechanical pressure on the end parts of the expansion plates, the opening between the expansion plates may also be made bigger or smaller. When the mechanical pressure on the end parts cease the expansion plates will automatically return substantially to their initial positions. However, it is to be noted that the expansion plates may also be pulled away from each other, for example in an area around the middle, or in the middle of their length, for such to provide an opening between the expansion plates, wherein the size of the opening is dependent on the amount of mechanical pulling force applied to the expansion plates.

Each expansion plate may also be formed with several articulated joints over its length, such that upon compression or stretching, they stretch the dosage membrane into another geometric form than the one obtained by having the expansion plates exclusively "hinged" in each end. Moreover, the expansion plates may be formed with an equal or different number of articulated joints.

To achieve the best possible closing after the expansion plates have substantially returned to their initial position, at least two closing plates may be mounted between the dosage membrane and the opening in the flexible package. The closing plates are mounted at the inner face or outer face of the expansion plates, and are formed such that they are brought into contact with each other when the expansion plates have substantially returned to their initial position. The closing plates may then be arranged partly overlapping the dosage membrane, such that the closing plates form an extension of the dosage membrane.

The closing plates of the dosage device may be produced from a relatively elastic material, for example a thin elastic plastic material, and may be specifically designed to provide the best possible closing properties. It is also possible to contemplate the closing plates or sealing plates being integrated into the expansion plates, e.g., by plastic casting, and they may also be formed with one or more "lips" to provide the best possible closing properties.

The dosage membrane of the dosage device may be manufactured from a relatively elastic material, for example a relatively thin elastomer (synthetic rubber), where, over at least a part of the length and/or width of the dosage membrane, a number of through-going incisions are provided. The through-going incisions may have the same or different size, be of the same or different form, be arranged in a specific pattern, etc. The dosage membrane may also be formed with almost through-going incisions, or material instructions which will be ripped open the first time the dosage membrane is stretched.

When the dosage membrane is stretched, the material on each side of the incisions will be exposed to a tension force, and thus, openings appear which will vary in size depending on the tension force applied to the material on each side of the incisions.

The dosage membrane of the dosage device could also be manufactured from an elastic grid, which in a no-load condition has no opening or very little opening between the mesh of the grid. By putting strain on the elastic grid by stretching or straining, openings will be provided between the mesh of the grid, where the size of the openings will be dependent on the strain put on the elastic grid. Such an elastic grid could be envisaged manufactured from very thin and elastic filaments which are arranged in two or more layers, where the filaments in one layer may be arranged in an angle to another overlying or underlying layer. The intersections of the filaments between the adjacent layers will then be welded together, for such to provide meshes in the flexible grid.

The dosage membrane may be manufactured from one single material layer. However, the dosage membrane may also be manufactured from two or more material layers, wherein at least one of the material layers coinciding edges, when the material layers are arranged above each other, in a suitable way are joined together.

Upper edge of the dosage membrane, on the upper face of the expansion plates, may be completely straight, and this will cause the dosage membrane to be stretched more in the middle of the expansion plates than at the ends of the expansion plates when the expansion plates are subjected to mechanical loads at the ends, or tension in an area around the middle of the length of the expansion plates. By instead forming the upper edge with a curved form, it is possible for example to achieve having the dosage membrane stretch more evenly when the expansion plates are subjected to mechanical loads at the ends, and this causes the incisions of the dosage membrane to substantially open more uniformly in the area between the expansion plates. Alternatively, the upper edge of the expansion plates may be formed curved, for thus to obtain the same effect.

The dosage device arranged in the flexible package may in an embodiment be provided by welding an end or an area of the dosage membrane adjacent the expansion plate to an outer face of one of the expansion plates, over the complete length of the expansion plate, and an opposite end or an area of the dosage membrane adjacent the other expansion plate to an outer face of the other expansion plate, over the complete length of the dosage device. However, the dosage membrane may be welded to an inner face of the expansion plates, over the complete length of the expansion plates. By fixing the dosage membrane in this way between each of the expansion plates, the dosage membrane will be stretched when the expansion plates are subjected to a mechanical load at their ends. Dependent on how much the dosage membrane is stretched, this stretching will cause the size of the holes appearing in the incisions formed in the dosage membrane to be made larger or smaller.

The expansion plates may be mounted on the inner face of the flexible package, and welded to the dosage membrane. However, in practical embodiments, the expansion plates can be welded to the outer face of the flexible package. For example, this may be the case when it is desired to use materials for the expansion plates which are not approved for contact with the product held in the flexible package and/or if it is desired to use externally mounted gripping devices to stretch the internally mounted dosage membrane. In such an embodiment, both the dosage membrane and the closing plates may be fixed or connected to an inner face of the flexible package.

It is also possible to use externally mounted gripping devices even if the expansion plates are mounted inside the flexible package. The externally mounted gripping devices may then be fixed to the outer face of the package.

To prevent any of the product held in the flexible package leaking out before the package is used, the flexible package in this case is arranged such that the dosage device faces down, the dosage membrane and/or the expansion plates are welded to an inner face of the package material, for such to form a tight connection between the dosage device and the layer(s) of the package material.

In another embodiment of the flexible package according to the present invention, one or more sealing plates may be arranged at an inner face of the package material(s). Each sealing plate, over at least part of its length and along one of its edges, is connected to this layer of the packaging material. The connection between the layer package material and sealing plate may, for example, be obtained with gluing, heat welding, ultra sound welding, or the like.

A second end of each sealing plate may then abut an outer face of the dosage membrane, for such to provide a substantially tight connection between the dosage device and the layers of the package material. Such a device may enable a lateral displacement of the dosage device, such that larger amounts of a product may be poured from the opening of the flexible package at one or both sides of the dosage device. In this case, the dosage device will not be active.

In an embodiment, the sealing plates may be produced from a resilient or elastic material, e.g., rubber, but may also be manufactured from an elastic plastic material, e.g., an elastomer (synthetic rubber). The sealing plates may also be produced from punching out a film or by plastic molding/extrusion, and may be specifically designed for the purpose. The sealing plates may also be mounted and welded with a small pre-tensioning in the material, such that the sealing against the dosage device is improved even further.

The dosage device may be produced as a continuous ribbon, whereby the ribbon is cut into suitable dosage device units. Such a dosage device unit will be inserted through the opening in the top of the flexible package, wherein the flexible package for example may be present in the form of a flexible pipe or tube, such that the dosage device unit is arranged at an inner face and around the complete circumference of the flexible package. Then, the dosage device unit is welded to the flexible package with a welded connection, whereby the dosage device not necessarily has to be connected with a weald seam. Moreover, expansion plates and/or sealing plates may be integrated in the continuous ribbon.

In yet another embodiment of the flexible package according to the present invention, the flexible package may be produced to provide a completely open package, as one of the expansion plates, when the dosage device is compressed or pulled apart, is able to be pushed over toward the other expansion plate. The dosage membrane, which is welded to the expansion plate, will then follow the movement of this expansion plate.

In yet another embodiment of the flexible package according to the present invention, the flexible package may be manufactured to provide a partly open package, as the dosage membrane which is fixed along the edge at the top of the expansion plates, at one or both sides, is extended and fixed at the inner face of the flexible package. Below the edge of the expansion plates, in the area where the dosage membrane is fixed, a longitudinal incision has been made which is used to provide a larger or smaller hole in the dosage membrane when it is stretched transversely to the incision.

By one of the expansion plates being pushed towards the other expansion plate, when the dosage device is compressed or pulled apart from each other, the dosage membrane will be stretched and a larger or smaller hole will be provided in the dosage membrane because of the longitudinal incision. To prevent the side walls of the flexible package from collapsing, if the flexible package material lack the necessary mechanical rigidity, a stiffening plate may be fixed inside the flexible package.

The stiffening plates may be formed as resilient plates, which for example may be produced from a thin but relatively rigid plastic material.

BRIEF DESCRIPTION OF THE DRAWINGS

The above disclosed and other objects, features, and advantages of the invention will become clear from the following more specific disclosure of the preferred, non-limiting embodiments of the invention, as illustrated in the appended drawings:

FIGS. 1A-1B illustrate a principal configuration of a first embodiment of a package of a flexible material according to the present invention, wherein FIG. 1A shows the flexible package in cross section seen from ahead (one of the side walls of the flexible package is removed), and FIG. 1B shows a cross section through the flexible package seen from the side, through a section A-A shown in FIG. 1A, FIGS. 1C-1D illustrate a principal configuration of an alternative embodiment of the package shown in FIGS. 1A-1B, wherein FIG. 3B shows a cross section through the flexible package seen from the side, through a section A-A shown in FIG. 3A, FIGS. 3C-3D illustrate a principal configuration of an alternative embodiment of the package shown in FIGS. 3A-3B, wherein FIGS. 9A-9B show a principal configuration of a further embodiment of a flexible package according to the present invention, wherein FIG. 9A shows the flexible package in cross section seen from ahead (one side wall of the flexible package is removed), and FIG. 9B shows a cross section through the flexible package seen from the side, through a section A-A shown in FIG. 9A.

FIGS. 9C-9D illustrate a principal configuration of an alternative embodiment of the package shown in FIGS. 9A-9B, wherein FIG. 9C shows the flexible package in a cross section seen from ahead (one of the side walls of the flexible package is removed), and FIG. 9D shows a cross section through the flexible package seen from the side, through a section A-A shown in FIG. 9C, FIGS. 10A-10B show a dosage device and a "pouring device" with a partly full opening according to the embodiments of the flexible package shown in FIGS. 9A-9D, seen from above, FIGS. 11A-11B show a principal configuration of another embodiment of a flexible package according to the present invention, wherein FIG. 11A shows the flexible package in a cross section seen from ahead (one of the side walls of the flexible package is removed), and FIG. 11B shows a cross section through the flexible package seen from the side, through a section A-A shown in FIG. 11A, and FIGS. 12A-12C show a principal embodiment of a closing mechanism to squeeze the expansion plates together after opening of the flexible package.

DETAILED DESCRIPTION OF THE INVENTION

According to the present invention, a package of a flexible material shall be understood to be the same as a flexible package, and these terms will be used interchangeably in the present application.

Figure 1A:
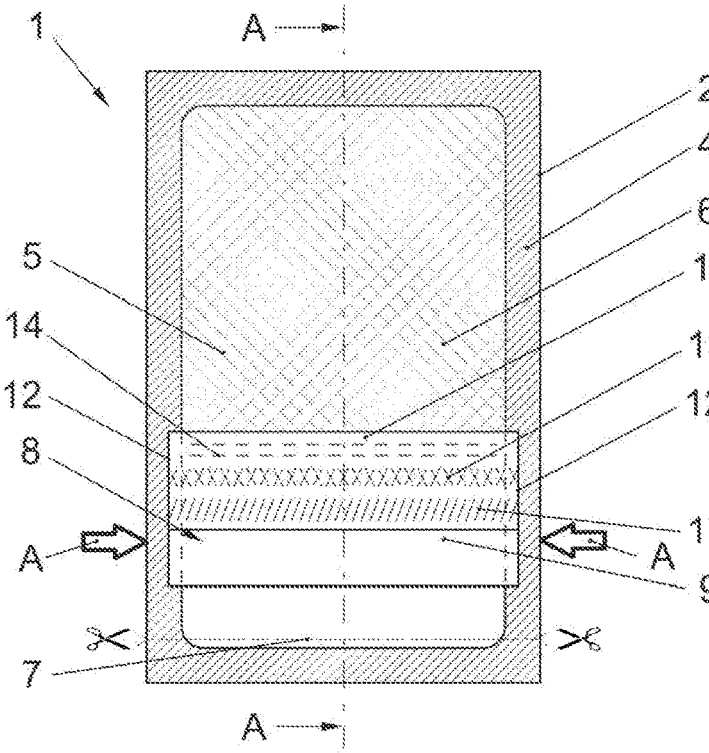
Figure 1B:
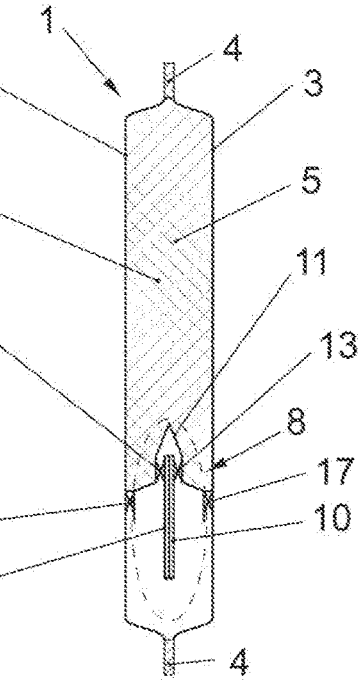
Figure 1C:
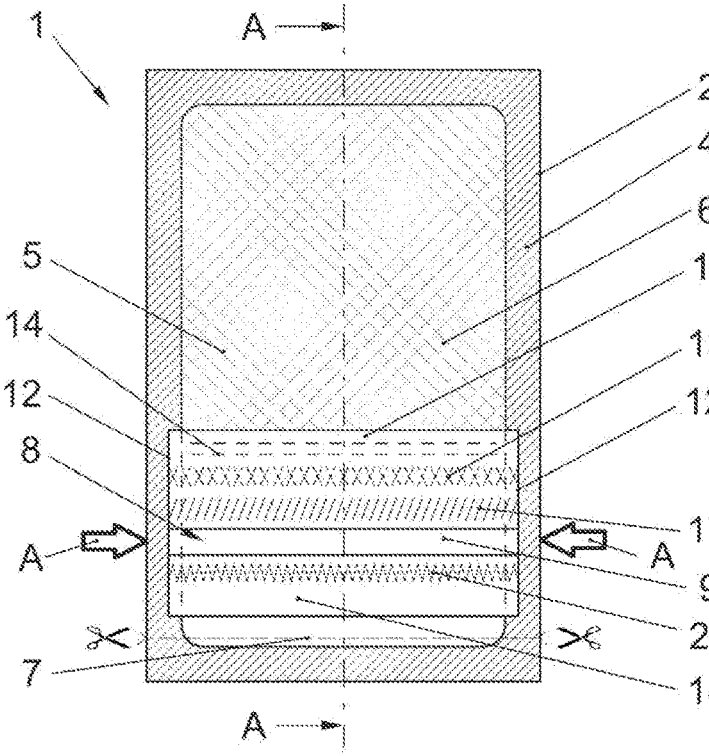
FIG. 1C shows the flexible package in cross section seen from ahead (one of the side walls of the flexible package is removed)
Figure 1D:
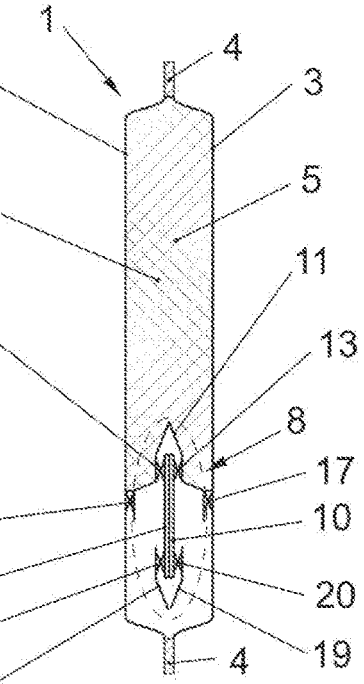
FIG. 1D shows a cross section through the flexible package seen from the side, through a section A-A shown in FIG. 1C, FIGS. 2A-2B show a dosage device contained in the flexible package of FIGS. 1A-1D, seen from above, wherein the dosage device of FIGS. 2A and 2B is subjected to a different mechanical pressure.

In FIGS. 1A and 1B, a first embodiment of a package 1 of a flexible material according to the present invention is shown, and FIGS. 1C and 1D show an alternative embodiment of the embodiment shown in FIGS. 1A and 1B, wherein the flexible package 1 is filled with a grainy, granular, or powdery product. For example, the product may be ground or granular spices, such as salt, pepper, cinnamon, oregano, or the like.

FIGS. 1A and 1C show a "cross section" of the package 1 of a flexible material, wherein an outer layer 2 which forms a side wall in the flexible package 1 is removed. FIGS. 1B and 1D show a cross section through section A-A in the package 1 of a flexible material.

However, it is to be understood that the flexible package 1 according to the present invention may also be used to contain other products, such as different medical or cosmetic powders, for example talcum, powder, or a dry shampoo powder.

The flexible package 1 comprises two external layers 2, 3 which are arranged opposite each other and then joined to form a joint 4 around their outer edges, so as to create a closed volume 5 in the flexible package 1, which closed volume 5, partly or completely, is filled with a product. The two outer layers 2, 3 will then each form a side wall, or frontal and rear walls, in the flexible package 1 when this is manufactured.

However, a person skilled in the art will understand that the flexible package 1 according to the present invention may also be provided from one layer which is folded about a folding edge and then joined with joint 4 around its "open" edges (i.e., around three of its outer edges) to form a closed volume 5 in the flexible package 1.

The joint 4 of the outer edges of the layer(s) 2, 3 of the flexible package 1 may, for example, be formed with glue, welding with heat, ultrasound or laser, or using other similar joining techniques.

The joint 4 is to be understood to be such that it provides a tight connection in the flexible package 1, such that the product in the flexible package 1 for example does not lose its aroma and/or taste.

Against an end of the flexible package 1, there is arranged a weakened tear or perforated area 7, running substantially transverse to the width of the flexible package when seen from ahead so as to provide a opening mechanism in the flexible package 1 before use. The weakened tear or perforated area 7 is arranged such that it is also running through the closed volume 5, such that when the tear or perforated area 7 is torn or cut away, this will provide an opening of the flexible package 1.

Above the weakened tear or perforated area 7, a dosage device 8 is arranged, and the dosage device 8 in this embodiment comprises a dosage membrane 11 and an opening device in the form of two expansion plates 9, 10. The expansion plates 9, 10 are in a suitable way coupled or connected in each of their short ends 12, so as to form a hinge function and resilient function in the dosage device 8. In this way, the expansion plates 9, 10 will, when a user presses the coupled short ends 12 of the expansion plates 9, 10 against each other as shown with arrows A in FIG. 1C, be pushed away from each other so as to provide an opening between them (see also FIGS. 2A and 2B). The size of the opening between expansion plates 9, 10 will vary depending on the magnitude of the mechanical pressure on the short ends 12. When the user releases the pressure, the expansion plates 9, 10 will resume their initial positions, in which initial position the expansion plates 9, 10 mainly are in contact with each other over their complete length.

The dosage membrane 11 will then be welded to each of the expansion plates 9, 10, over the total length of the expansion plates 9, 10, at an outer face of the expansion plates 9, 10, through a first weld 13. The dosage membrane 11 is also welded to an inner face of each of the external layers 2, 3, through a second weld 17. In addition, the short ends 12 of the dosage device 8, through the joint 4, also are welded to the external layers 2, 3. In this way, the expansion plates 9, 10, the dosage membrane 11, and the joint 4, will create a closed and tight delimitation of the closed volume 5 in the flexible package 1, when the expansion plates 9, 10 are not subjected to a mechanical compression or stretching. The expansion plates 9, 10 may in certain cases also be part of the second weld connection 17. In such a case, the second weld 17 will create a connection from the inner side of the external layers 2, 3, through the dosage membrane 11 and to the expansion plates 9, 10.

The first weld 13 between the dosage membrane 11 and the expansion plates 9, 10 may be made as a continuous weld over the total length of the expansion plates 9, 10, or it may be made as a number of spot welds/part welds of a certain length, etc.

The expansion plates 9, 10 are made up of a thin, but relatively rigid plastic plate, which will also possess resilient properties.

Figure 2A:
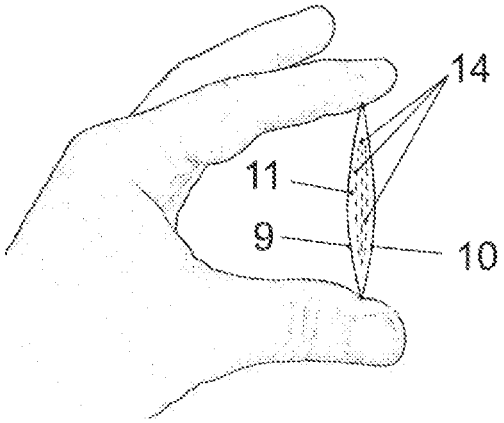
Figure 2B:
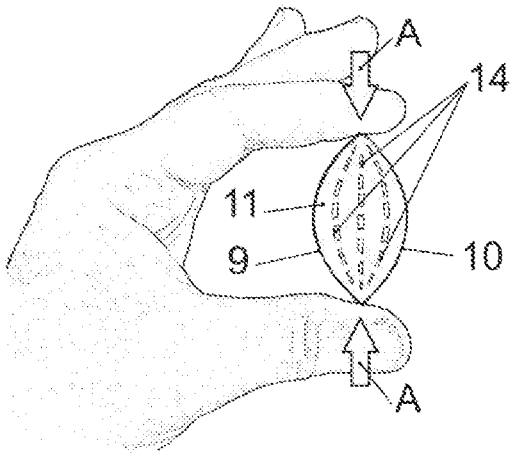

The dosage membrane 11 is produced from a relatively elastic material or a film, wherein the dosage membrane 11 is perforated with a number of through-going incisions (through-holes formed as slits) 14, at least over part of its width and length. The through-going incisions 14 may, for example, as shown in FIG. 2B, be arranged in three rows.

The incisions 14 may also be formed as "almost through-going" (i.e., recesses not extending entirely through the membrane 11), whereby they will be ripped open the first time the dosage device 11 is stretched.

As seen in figures, the length of the expansion plates 9, 10 and dosage membrane 11 will substantially correspond to at least the width of the closed volume 5 of the flexible package 1 when seen from ahead, such that the expansion plates 9, 10 and the dosage membrane 11 will be connected to the external layers 2, 3 also through the joint 4.

After having opened the flexible package 1, i.e., after tearing or cutting away the weakened tear or perforated area 7, the product held in the flexible package 1 may be poured out by applying a mechanical pressure to the edges of the flexible package 1, such as shown with arrows A in FIG. 1A. Depending on the magnitude of the mechanical pressure on the flexible package 1 and the expansion plates 9, 10, the dosage membrane 11 will, because of the opening provided between the expansion plates 9, 10, be stretched or pulled to a greater or lesser extent. This will also result in the through-going incisions (through-holes) 14 being subjected to the same stretching or pulling, such as shown in FIGS. 2A and 2B.

In FIG. 1C, 1D an alternative embodiment of the package 1 shown in FIGS. 1A, 1B is illustrated, wherein, for simplicity, only the differences that exist between the embodiments shall be described.

In this alternative embodiment, the flexible package 1 can be provided in the same way as described concerning the embodiment shown in FIGS. 1A and 1B, i.e., in relation to the joint 4 between the layers 2, 3, for creating the closed volume 5, as well as the tear or perforated area 7. Above the weakened tear or perforated area 7, a dosage device 8 is arranged.

However, in this alternative embodiment, the dosage device 8 will be formed differently, because the dosage device 8 comprises a dosage membrane 11, an opening device in the form of two expansion plates 9, 10, and two closing plates 18, 19. The expansion plates 9, 10, as disclosed in relation to FIGS. 1A and 1B, are in a suitable way connected or coupled in each of their short ends 12, so as to form a hinge and resilient function in the dosage device 8. Furthermore, through a weld 13, the dosage membrane 11 is connected to the expansion plates 9, 10 to an outer face of the expansion plates 9, 10. The dosage membrane 11, through the second weld 17, is also connected to an inner face of the two layers 2, 3. The welds 13, 17, will then be arranged at a distance from each other. In this way, the expansion plates 9, 10, the dosage membrane 11, and the joint 4 will create a closed and tightly delimitation of the closed volume 5 in the flexible package 1. As disclosed earlier, the expansion plates 9, 10 may in certain cases be envisaged to be part of the second weld connection 17. In such a case, the second weld 17 will form a connection from the inside of the external layers 2, 3, through the dosage membrane 11 and to the expansion plates 9, 10.

The welding of the dosage membrane 11 and the expansion plates 9, 10 may be made as a continuous weld over the total length of the expansion plates 9, 10, and along the upper edge, or it may also be performed as a number of spot welds/part welds of a certain length, etc.

In order to provide a tight closure of the flexible package 1 and the dosage device 8, the closing plates 18, 19 are connected to an outer face of the expansion plates 9, 10, over the total length of the expansion plates 9, 10, and along lower edge of the expansion plates 9, 10, when seen in figures, through a third weld 20. Thus, the welds 20, 13 will be arranged on opposite edges (ends) of the expansion plates 9, 10. Moreover, the closing plates 18, 19 are, as shown in FIG. 1C, connected to the flexible package 1 through the joint 4.

The dosage membrane 11 is produced from a relatively elastic material or a film, wherein the dosage membrane 11 is perforated with a plurality of through-going incisions (through-holes) 14, at least over a part of its width and length. The through-going incisions 14 may, for example, as shown in FIG. 2, be arranged in three rows.

The dosage membrane 11 may also be formed with "almost through-going" holes or incisions (i.e., recesses) 14, or material indications which will be torn open the first time the dosage membrane 11 is stretched.

The closing plates 18, 19 are manufactured from a thin, but relatively elastic material (e.g., an elastomer), and is formed specifically to provide the best possible closing properties. It is also possible to have the closing plates integrated as part of the expansion plates 9, 10, for example, by using plastic molding. Moreover, the closing plates 18, 19 may be formed with one or more lips or other shaping to provide the best possible closing features. A person skilled in the art will know how to do this, and thus, this is not further described here.

After opening the flexible package 1, i.e., after having torn or cut away the weakened tear or perforated area 7, the product contained in the flexible package 1 may be poured/delivered as described in relation to the embodiments shown in FIGS. 1A, 1B.

In FIG. 2A, the flexible package 1 is subjected to only a small mechanical pressure, in that the user has pressed onto the edges of the flexible package 1 at arrows A, i.e., at the edges of the expansion plates 9, 10. The expansion plates 9, 10 will then be pushed a distance apart, and this will tension or stretch the dosage membrane 11 out in a direction transverse of a direction of squeezing. This tension or stretching of the dosage membrane 11 will then result in that the holes or incisions 14 are tensioned or stretched. The product contained in the flexible package 1 may then be sprinkled out from the flexible package 1 through the holes or incisions 14 in the dosage membrane 11.

In FIG. 2B, the flexible package 1 is subjected to a greater mechanical pressure than in FIG. 2A, wherein this has caused the dosage membrane 11 to be tensioned or stretched more out in the direction transverse to the direction of compression. This will also cause the holes or incisions 14 to become more open or larger, such that more of the product in the flexible package 1 may "sprinkle" out.

When the user finishes pouring the product from the flexible package 1, the user will release the pressure, and the expansion plates 9, 10 will then, due to their rigidity and elasticity, substantially return to their initial positions, and the holes or incisions 14 will close up. In addition, in the embodiment shown in FIG. 1C, 1D, the closing plates 18, 19 will be used to close the flexible package 1, as an extra security.

Thus, the above structure or design of the dosage device 8 will enable the user to regulate how much of the product held in the flexible package 1 can be poured/delivered, wherein a lesser pressure on the expansion plates 9, 10 will result in that a smaller amount of the product is poured/delivered, and a higher pressure on the expansion plates 9, 10 will result in that a larger amount of the product can be poured/delivered. In addition, the dosage device 8 provides an automatic closing of the flexible package 1 when the flexible package 1 is not used, both by substantially completely "closing" the through-going incisions 14 of the dosage membrane 11 when the flexible package 1 is not subjected to a mechanical pressure, as well as by the closing plates 18, 19, shown in FIGS. 1C, 1D, together also forms a substantially tight connection when the flexible package 1 is not subjected to a mechanical pressure and the expansion plates 9, 10 are joined together. Because of this, the product contained in the flexible package 1 will keep its aroma and/or taste longer.

Figure 3A:
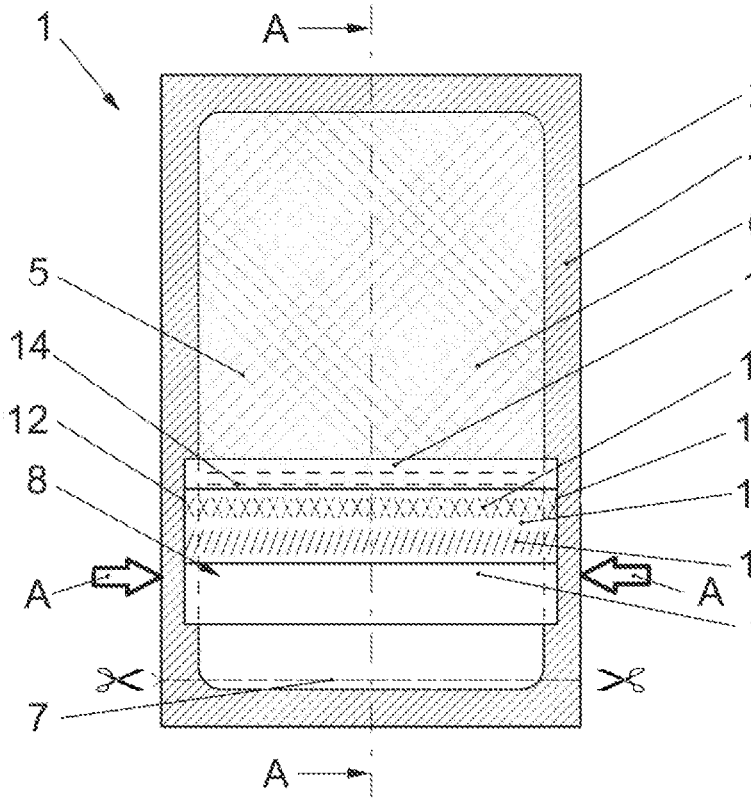
FIGS. 3A-3B show a principal configuration of a second embodiment of a flexible package according to the present invention, wherein FIG. 3A show the flexible package in cross section seen from ahead (one of the side walls of the flexible package is removed)
Figure 3B:
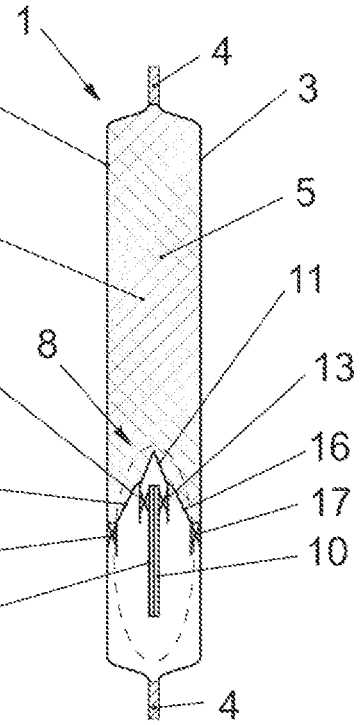

FIGS. 3A-3B show another embodiment of a package 1 of a flexible material according to the present invention, wherein FIG. 3A shows the flexible package 1 seen from ahead, and FIG. 3B shows a cross section through the flexible package 1 from the side.

The flexible package 1 comprises two external layers 2, 3 which are put together and then joined/welded together around its outer edges with a weld joint 4, so as to create a closed volume 5 in the flexible package 1, which closed volume 5 is partly filled with a spice, for example.

Toward an end of the flexible package 1, there is arranged a weakened tear or perforated area 7, running transverse to the length of the flexible package 1, so as to provide an opening mechanism in the flexible package 1 before use. The weakened tear or perforated area 7 is arranged such that it also runs through the closed volume 5, such that when the weakened tear or perforated area 7 is ripped open or cut away an opening of the flexible package 1 is provided.

Above the weakened tear or perforated area 7, when seen in the Figure, a dosage device 8 is arranged, which dosage device 8 in this embodiment comprises a dosage membrane 11 and an opening device in the form of two expansion plates 9, 10. The expansion plates 9, 10 are coupled or connected in each of their short ends 12, so as to form a hinge or resilient function in the dosage device 8. The dosage membrane 11 will then be welded to the expansion plates 9, 10 over the entire length of the expansion plates 9, 10, on an outer face of the expansion plates 9, 10, through the weld 13. In addition, the short ends 12 of the dosage device 8 will also be welded to the two external layers 2, 3 through the weld seam 4.

For example, the expansion plates 9, 10 may be constituted by a thin, but relatively rigid material, a grid or the like.

The dosage membrane 11 is made from a relatively elastic plastic film, wherein the dosage membrane 11 is perforated with a plurality of through-going or partly through-going (almost through-going) incisions (through-holes or recesses) 14 at least over part of its width and length. The through-going incisions 14 may, for example, as shown in FIG. 2, be arranged in three rows.

It is to be understood that the through-going or partly through-going holes or incisions 14 may be arranged in more or fewer than three rows, that the through-going or partly through-going holes or incisions 14 may be arranged in a random pattern, and that they may have the same or different shape and/or size.

After having opened the flexible package 1, i.e., after having ripped apart or cut away the weakened tear or perforated area 7, the product contained in the flexible package 1 may be poured out by applying a mechanical pressure on the edges of the flexible package 1, such as shown with arrows A in FIG. 1. Depending on how large the mechanical pressure on the expansion plates 9, 10 is, the dosage membrane 11 is stretched or is opened to a smaller or greater extent, and this also causes the holes or incisions 14 to be subjected to this stretching or opening, such as explained above and shown in FIGS. 2A and 2B.

As described above, the dosage membrane 11 is welded to an outer face of the expansion plates 9, 10 over the total length of the expansion plates 9, 10 by the first weld 13, see also FIGS. 3A and 3B. According to this embodiment of the present invention, a set of resilient or elastic sealing plates 15, 16 is further arranged at an outer face of the dosage membrane 11 and the expansion plates 9, 10, such that one of the resilient or elastic sealing plates 15 will abut an outer face of the dosage membrane 11 (left side of the dosage membrane 11 shown in FIG. 3B), and the other resilient or elastic sealing plate 16 will abut an opposite outer face of the dosage membrane 11 (right side of the dosage membrane 11 shown in FIG. 3B).

The resilient or elastic sealing plates 15, 16 are, through an outer face, welded to an inner face of the external layers 2, 3. This is shown through the welding seam 17.

Through the above described design of the dosage device 8 and the set of resilient or elastic sealing plates 15, 16, the resilient or elastic sealing plates 15, 16 will sealingly abut the outer face of the dosage membrane 11, such that the product held in the flexible package 1 cannot escape between the resilient or elastic sealing plates 15, 16 and the dosage membrane 11 when the dosage device 8 is used to pour or sprinkle out the product.

The design of the dosage device 8 and the set of the resilient or elastic sealing plates 15, 16 will also result in that a completely open package may be provided, such that the product contained in the flexible package is poured out.

Figure 3C:
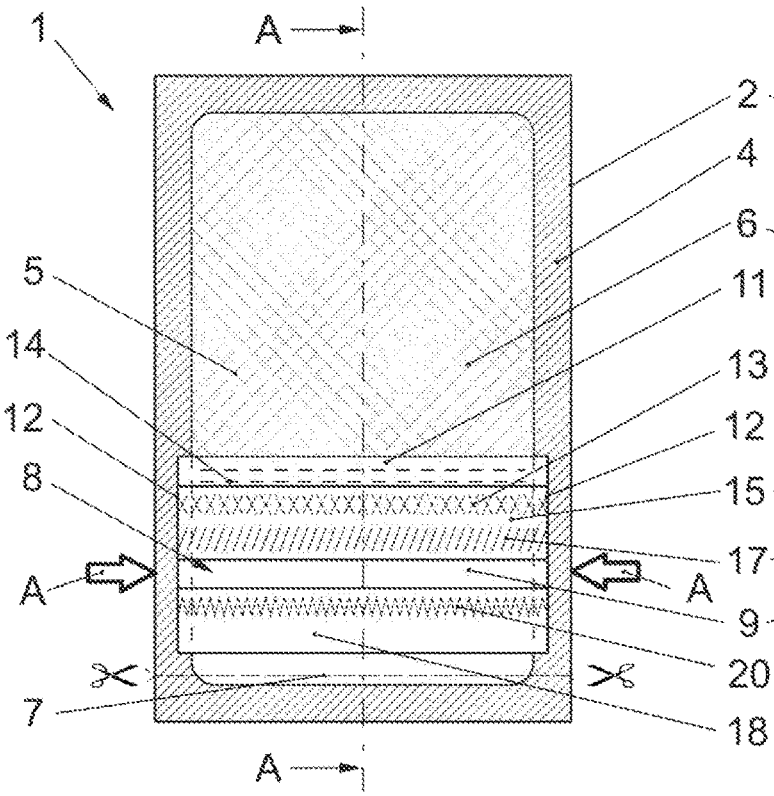
FIG. 3C shows the flexible package in cross section seen from ahead (one side wall of the flexible package is removed)
Figure 3D:
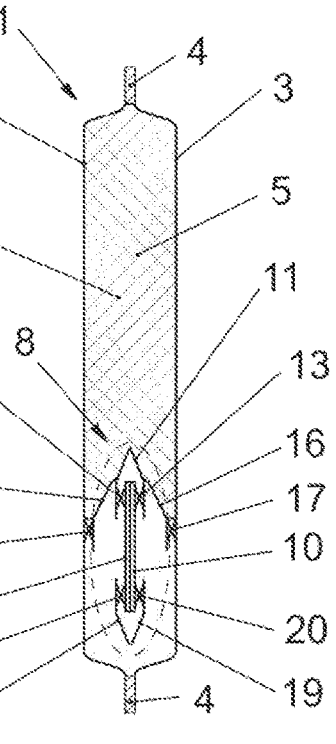
FIG. 3D shows a cross section through the flexible package seen from the side, through a section A-A shown in FIG. 3C, FIGS. 4A-4B show a dosage device and a "pouring device" according to the second embodiment of the flexible package shown in FIGS. 3A-3D, seen from above.

In FIGS. 3C, 3D, an alternative embodiment of the package 1 shown in FIGS. 3A, 3B, wherein, for simplicity, only the differences that exist between the embodiments shall be described.

In this alternative embodiment the package 1 may be provided in the same way as described in relation to the embodiment shown in FIGS. 3A and 3B, i.e., in relation to the joining 4 of the layers 2, 3, the creation of the closed volume 5, as well as the tear or perforated area 7. Above the weakened tear or perforated area 7, a dosage device 8 is arranged. However, in this alternative embodiment, the dosage device 8 will be differently designed, as the dosage device 8 comprises two expansion plates 9, 10, one dosage membrane 11, and two closing plates 18, 19. The expansion plates 9, 10 are, as described in relation to FIGS. 3A and 3B, in a suitable way joined at each of their short ends 12, so as to form a hinge and resilient function in the dosage device 8. Moreover, the dosage membrane 11 is through a weld connected to the expansion plates 9, 10, to an outer face of the expansion plates 9, 10.

The welding of the dosage membrane 11 and the expansion plates 9, 19 may be made as a continuous weld over the total length of the expansion plates, or it may also be performed as a number of spot welds, part welds of a certain length, etc.

To provide a tight closure of the package 1 and the dosage device 8, the closing plates 18, 19 are connected to an outer face of the expansion plates 9, 10 over the entire length of the expansion plates 9, 10, through a third weld 20. The third weld 20 is arranged at an opposite end of the weld 13. Further, as shown in FIG. 3C, the closing plates 18, 19 are connected to the package 1 through the joint 4.

The dosage membrane 11 is made from a relatively elastic material or a film, wherein the dosage membrane 11 is perforated with a number of through-going incisions (through-holes in the form of slits) 14, at least over a part of its width and length. The through-going incisions 14 may for example be arranged in three rows, as illustrated in FIG. 2.

The closing plates 18, 19 are produced from a thin, but relatively elastic plastic material (e.g., an elastomer), and, they are formed in particular to provide the best possible closing properties. It is also possible to contemplate the closing plates being integrated as part of the expansion plates 9, 10, for example by plastic molding. Moreover, the closing plates 18, 19 may be designed with one or more "lips" or other design to provide the best possible closing properties.

After opening the flexible package 1, i.e., after having torn open or cut away the weakened tear or perforated area 7, the product contained in the flexible package 1 may be poured/delivered by applying a mechanical pressure at the edges of the flexible package 1, such as shown by arrows in FIG. 1. Depending on how large the mechanical pressure is at the expansion plates 9, 10, the dosage membrane 11 will stretch or bend to a larger or lesser degree, and this also causes the through-going incisions 14 to be subjected to the stretching or bending, such as for example shown in FIGS. 2A and 2B.

The dosage membrane 11 is welded to an outer face of the expansion plates 9, 10, over the total length of the expansion plates 9, 10 through the weld 13, see also FIGS. 3A and 3B. According to this embodiment, a set of resilient or elastic sealing plates 15, 16 is arranged at an outer face of the dosage membrane 11 and the expansion plates 9, 10 such that the resilient or elastic sealing plate 15 will abut an outer face of the dosage membrane 11 (the left side of the dosage membrane 11 shown in FIG. 3D), and the other resilient or elastic sealing plate 16 will abut an opposite outer face of the dosage membrane 11 (right side of the dosage membrane 11, show in FIG. 3D).

Moreover, through an outer face, the resilient or elastic sealing plates 15, 16 are welded to an inner face of the external layers 2, 3. This is shown through the weld seam 17.

After having opened the flexible package 1, i.e., after tearing away or cutting off the weakened tear or perforated area 7, the product contained in the flexible package 1 may be poured/delivered as described in relation to the embodiment shown in FIGS. 3A, 3B.

Concerning the embodiments illustrated in the FIGS. 3A-3D, it is to be noted that even if a sealing plate 15, 16 is used on each side of the dosage membrane 1, it is to be understood that both sealing plates 15, 16, or only one sealing plate 15, 16, may be arranged at a side of the dosage membrane 11, whereby the dosage membrane 11 then at an opposite side will be welded to one of the side walls 2, 3.

Figure 4A:
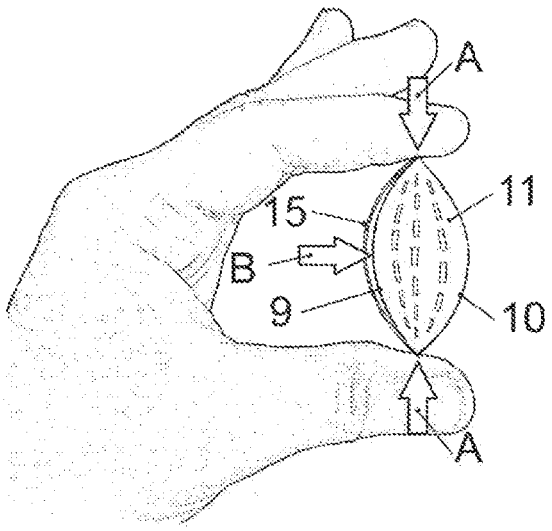
Figure 4B:
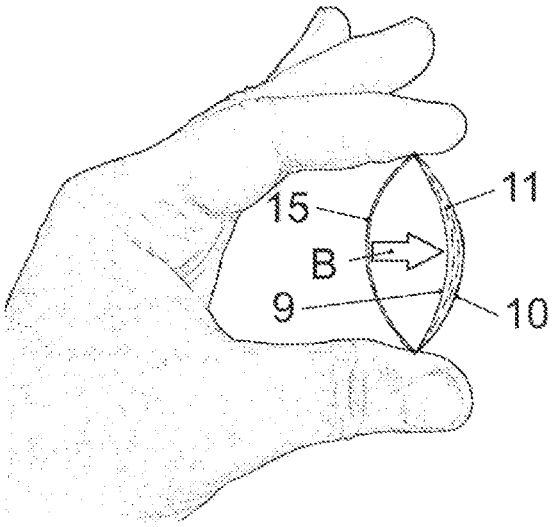

In FIGS. 4A and 4B, it is shown how a completely open package in the packages 1 described in relation to FIGS. 3A-3D may be provided. The user will first press together the expansion plates 9, 10 of the dosage device 8, as shown with arrow A in FIGS. 3A and 3C, and then push or shove one of the expansion plates 9, 10 transversely, as shown with arrow B, against the other of the expansion plates 10, 9.

Because of the properties of the expansion plates 9, 10, the expansion plate 9 will flip over against the other expansion plate 10, and the dosage membrane 11, which is welded to the expansion plates 9, 10, will follow the movement of the expansion plate 9. Then, a full opening in the flexible package 1 is formed, such as shown in FIG. 4B, such that the product held in the flexible package 1 may be poured out.

In FIG. 4A, a small opening between the sealing plate 15 and the expansion plate 9 is shown, and this is done to make the principal of providing a completely open, flexible package clear. A person skilled in the art would, however, understand that the sealing plates 15, 16 are arranged to abut the outer face of the dosage membrane 11 and the expansion plates 9, 10 in a sealing way such that the product held in the flexible package 1 can not escape between the resilient or elastic sealing plates 15, 16 and the dosage membrane 11 when the dosage device 8 is used to measure out or sprinkle the product.

In FIG. 4B, it is shown that the expansion plate 9 and the dosage membrane 11 has flipped over toward the expansion plate 10, whereby a full opening between the sealing plate 15 and the dosage membrane 11/expansion plate 9 is created such that the content of the flexible package 1 may be poured out.

FIGS. 5A-5D show a number of possible embodiments of a package itself of the flexible package 1 according to the present invention, and the dosage device 8 itself is only sketched. However, it is to be understood that the dosage device 8 is the same as described in the different embodiments shown in FIGS. 1A-1D, 3A-3D such that any of these dosage devices 8 may be used in relation to the different embodiments of the flexible package 1 itself.

Figure 5A:
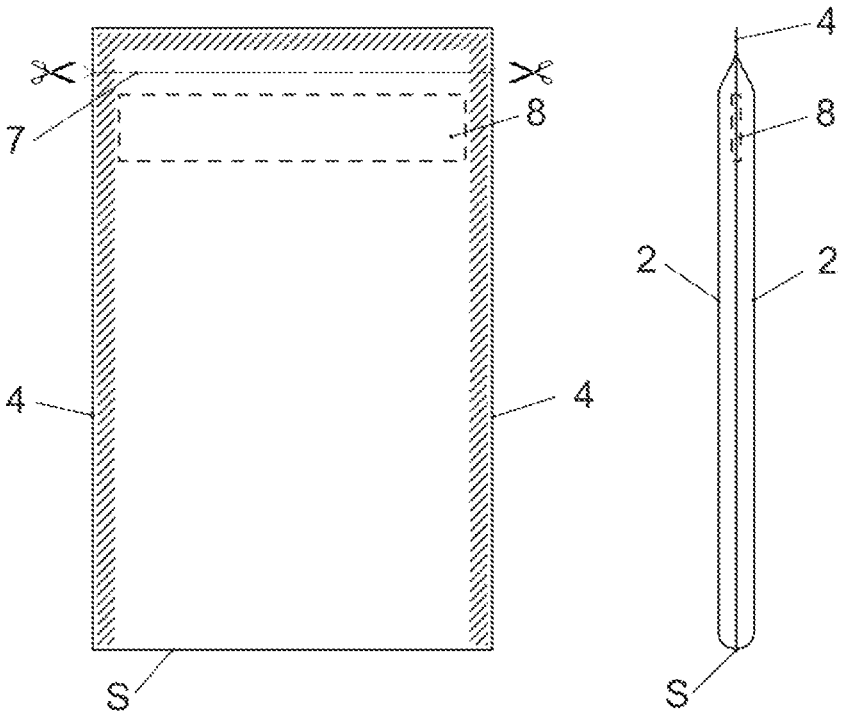
FIGS. 5A-5D show different embodiments of the package of a flexible material according to the present invention, in which flexible package a dosage device is arranged.

In FIG. 5A, the flexible package 1 is provided by folding a material layer 2 together around a folding line S, and then the material layer 2 is joined around three of its edges through the joint 4 to form a closed flexible package 1.

Figure 5B:
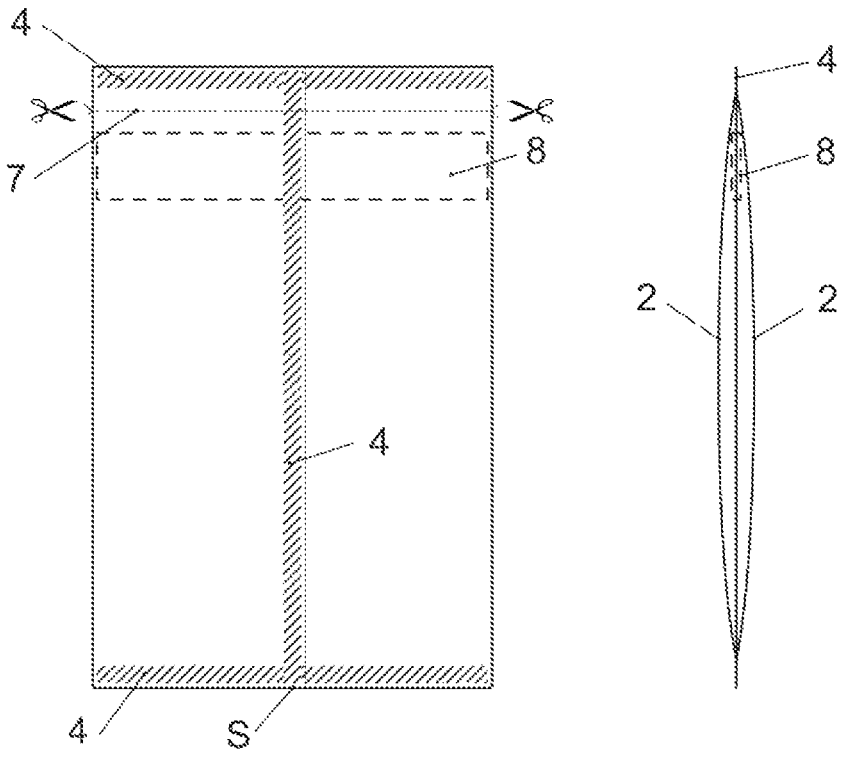

In FIG. 5B the flexible package 1 is provided by folding the side edges of a material layer 2 in towards the center of the center line S of the material layer 2, one side edge overlapping the other, and then the material layer 2 is joined along a upper edge, lower edge and the center line S by a joint 4, for such to form a closed flexible package 1.

Figure 5C:
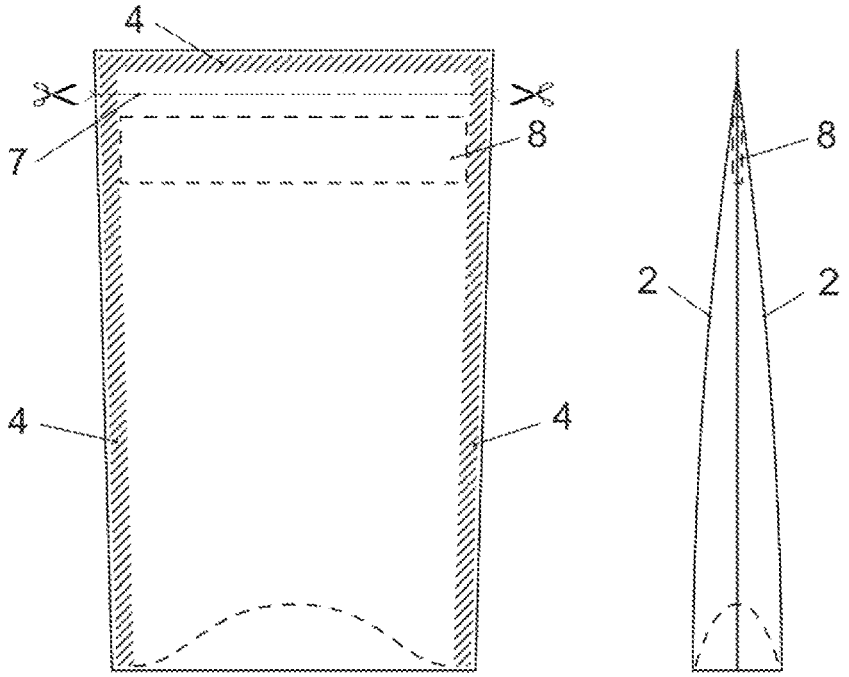

In FIG. 5C, the flexible package 1 is formed as a standing bag, as one material layer 2 is folded and joined through the joint 4 in such a way that there is formed a bottom in the flexible package 1 in an opposite end of the mounted dosage device 8, and which ensures that the flexible package may be arranged "standing".

Figure 5D:
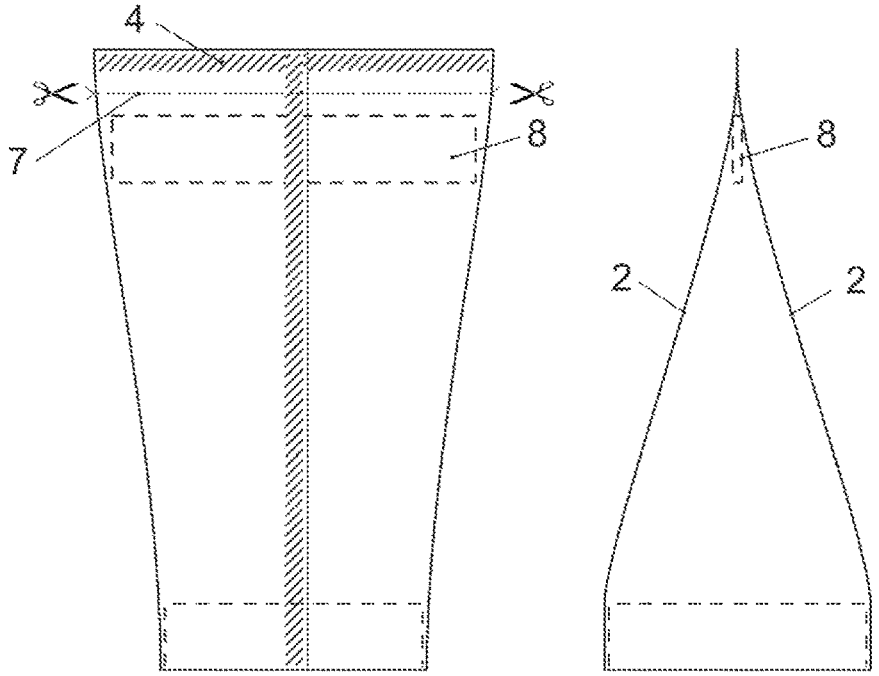

In FIG. 5D, it is shown that the flexible package 1 may also be provided in the form of a flexible pipe/tube by longitudinal folding of a package material from a roll, followed by longitudinal welding, or by for example injection molding/extrusion of a suitable plastic material into a thin walled, flexible and closed profile. Both of these examples may be arranged as a "standing" package by for example mounting a plastic lid, plug or the like, into the opposite end of the mounted dosage device 8. The dosage device 8 will be arranged in the flexible package similarly as described in relation to FIGS. 1A-1D, 3A-3D, etc., both with and without a weld seam 4. In the embodiments in which the flexible package 1 is not formed with a weld seam 4, the dosage device 8 will be fixed to an inner face of the wall(s) 2, 3 (which then is one material which is tubular) in the flexible package through weld 17 (see, also e.g., FIGS. 9A, 9C and 11A).

In these embodiments, the dosage device 8 may be produced as a continuous ribbon, after which the ribbon is cut into suitable dosage device units. Such a dosage device unit will be inserted into the opening in the top of the pipe or tube such that the dosage device unit is left on an inner face and all around the total circumference of the pipe or tube, and a certain pressure is exerted against the inner face of the pipe or tube. Then, the dosage device unit is welded to the pipe or tube with a weld connection 17, whereby the dosage device 8 must not necessarily be connected to the weld seam 4.

Figure 6A:
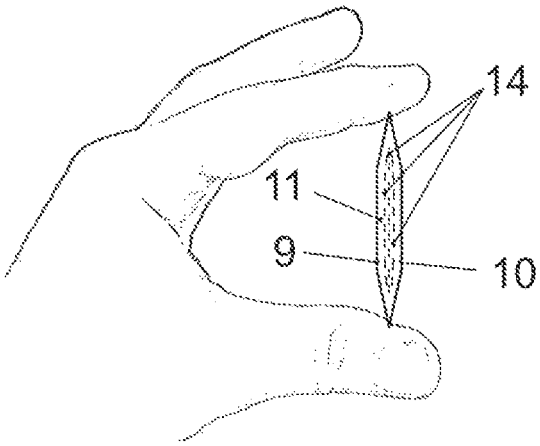
FIGS. 6A-6B show a dosage device contained in the flexible package of FIGS. 1A-1D, 3A-3D, seen from above, wherein expansion plates are formed with several "hinges" to achieve a desired geometric form for a dosage membrane by compressing the expansion plates.
Figure 6B:
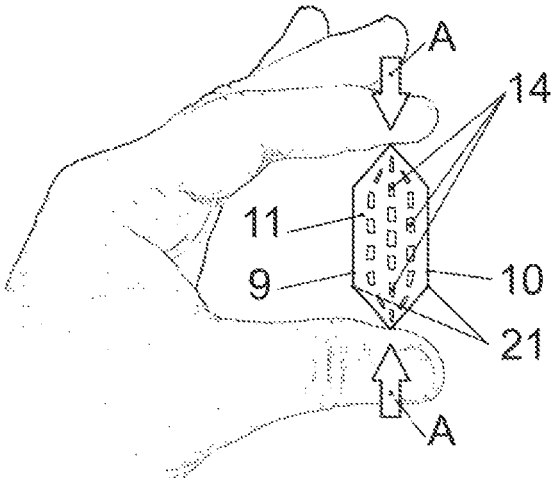

In FIGS. 6A-6B, a dosage device 8 is shown contained in the flexible package 1 in FIGS. 1A-1D, 3A-3D, 9A-9D, seen from above, in which the expansion plates 9, 10 are formed with several interconnected "hinges" 21 over its length, to obtain a desired geometrical form for the dosage membrane 11 by pushing the expansion plates 9, 10 together, through mechanical pressure on the edges of the flexible package 1, such as shown with the arrows A. The expansion plates 9, 10 will then be constituted by a number of partial plates, for example three, which in a suitable way are assembled to create the "hinges". A person skilled in the art will know how to perform this, thus, it is not described further herein. Then, two adjacent partial plates which form a hinge will then, by a mechanical pressure or stretch, form an angle to each other.

Figure 7A:
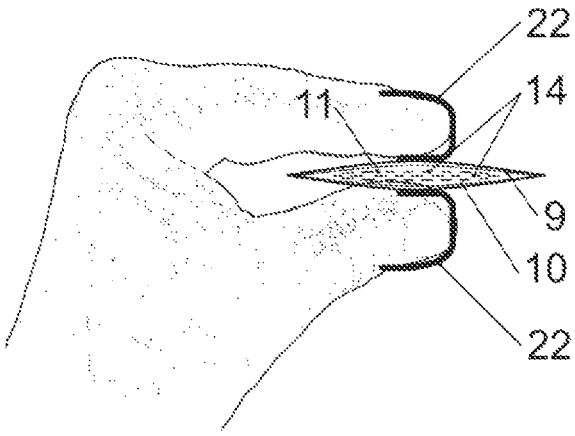
FIGS. 7A-7B show a dosage device contained in the flexible package of FIGS. 1A-1D, 3A-3D, seen from above, wherein a dosage membrane is stretched by pulling apart internal expansion plates using an externally mounted gripping device which is glued or welded to the outer face of the flexible package.
Figure 7B:
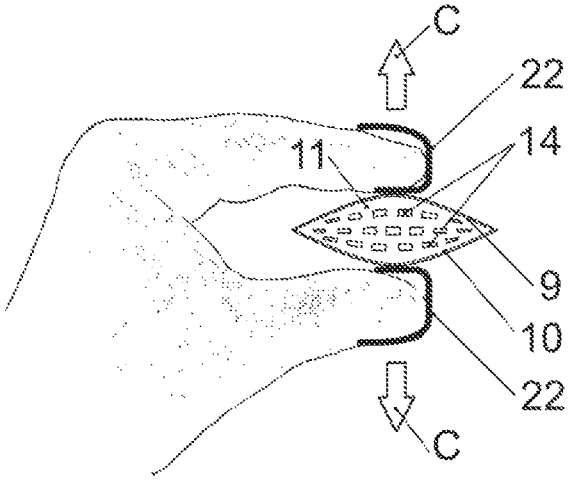

In FIGS. 7A-7B there is shown a dosage device 8 contained in the flexible package 1 according to the embodiments shown in FIGS. 1A-1D, 3A-3D, 9A-9D, seen from above, wherein the dosage membrane 11 is stretched as shown by arrows C, in that the internally mounted expansion plates 9, 10 are pulled apart with the fingers using the externally mounted gripping devices 22 which are glued or welded to the outer face of the flexible package 1.

Figure 8A:
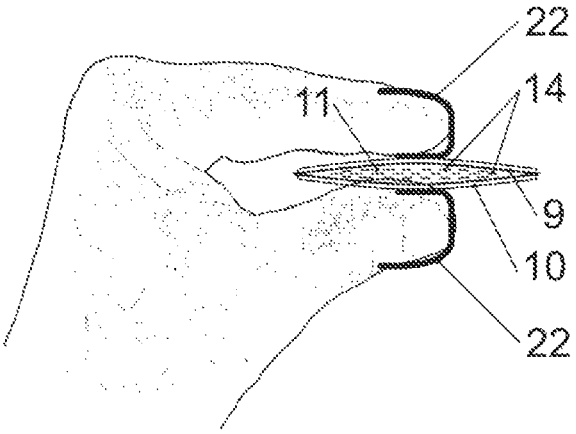
FIGS. 8A-8B show a dosage device contained in the flexible package of FIGS. 1A-1D, 3A-3D, seen from above, wherein expansion plates on the outer face of the flexible package and the dosage membrane are stretched by pulling the expansion plates apart using an externally mounted gripping device which is glue or welded to the outer face of the expansion plates.
Figure 8B:
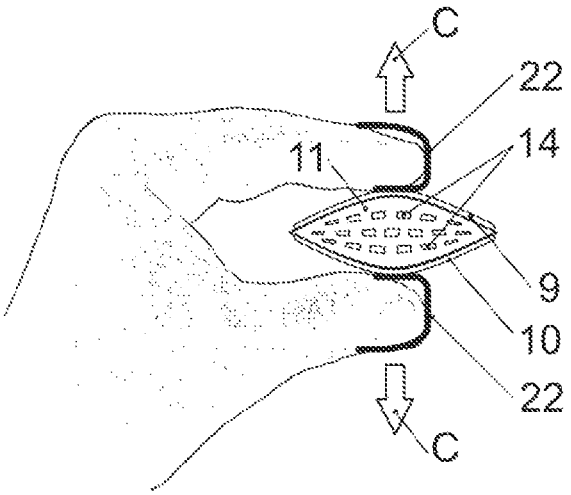

FIGS. 8A-8B show a dosage device 8 contained in the flexible package 1 according to the embodiments shown in FIGS. 1A-1D, 3A-3D, 9A-9D, seen from above, in which the expansion plates 9, 10 are glued or welded to the outer face of the flexible package 1. The dosage membrane 11 is stretched by pulling apart the external expansion plates 9, 10 with the fingers as shown with arrows C using the externally mounted gripping devices 22 which are glued or welded to the outer face of the expansion plates 9, 10.

Figure 9A:
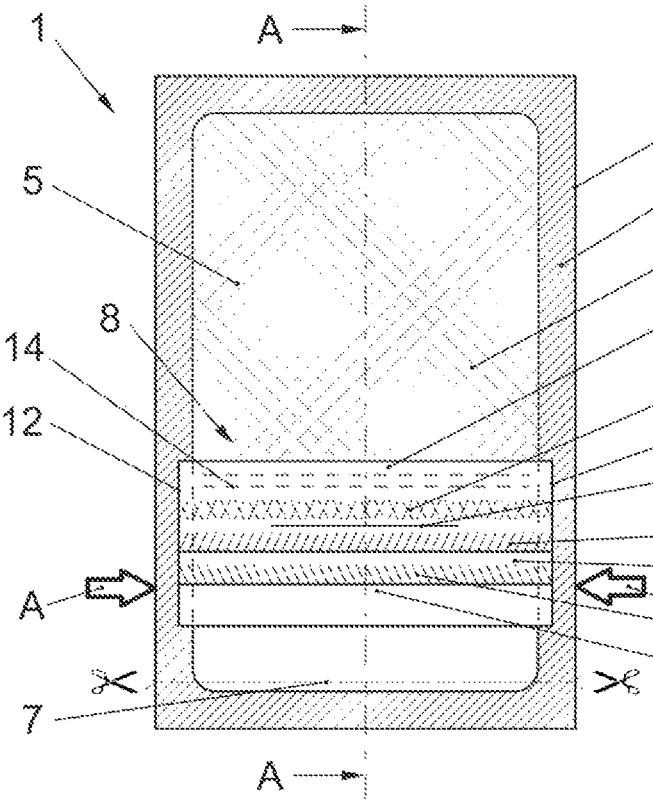
Figure 9B:
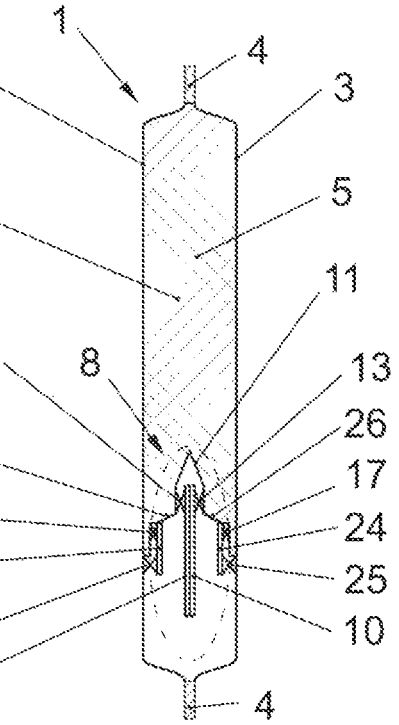

FIGS. 9A-9B show a third embodiment of a package 1 of a flexible material according to the present invention, in which FIG. 9A shows the flexible package 1 from ahead (i.e., the front), and FIG. 9B shows a cross section through the flexible package 1 from the side, through section A-A shown in FIG. 9A.

The flexible package 1 comprises two external layers 2, 3 which are assembled and then joined/welded together around their outer edges through a joint or weld seam 4, so as to form a closed volume 5 in the flexible package 1, which closed volume 5 is partly filled with for example a spice.

Towards an end of the flexible package 1 there is arranged a weakened tear or perforated area 7, running transverse to the length of the flexible package 1, so as to provide an opening mechanism in the flexible package 1 before use. The weakened tear or perforated area 7 is arranged such that it also runs through the closed volume 5, such that when the weakened tear or perforated area 7 is torn off or cut away, this will provide an opening in the flexible package 1.

Above the weakened tear or perforated area 7, and in a distance therefrom, there is arranged a dosage device 8, which dosage device 8 comprises two expansion plates 9, 10 and a dosage membrane 11. The expansion plates 9, 10 are connected in each of their short ends 12, so as to form a hinge and resilient function in the dosage device 8. Then, the dosage membrane 11 will be welded to the expansion plates 9, 10 over the entire length of the expansion plates 9, 10, at an outer face of the expansion plates 9, 10, through the weld 13. In addition, the short ends 12 of the dosage device 8 will also be welded to the two external layers 2, 3 by the weld seam (joint) 4.

The expansion plates 9, 10 may, for example, be constituted of a thin, but relatively rigid material, a grid or the like.

The dosage membrane 11 is made from a relatively elastic plastic film, wherein the dosage membrane 11 is perforated with a plurality of through-going or partly through-going (almost through-going) incisions 14, at least over a part of its width and length. The through-going incisions 14 may for example be arranged into rows, as illustrated in FIG. 2.

For example, the incisions 14 may possess a circular, oval, polygonal form, be straight incisions or the like, and may further be designed with the same or different opening.

After having opened the flexible package 1, i.e., after tearing off or cutting away the weakened tear or perforated area 7, the product held in the flexible package 1 may be poured out by applying a mechanical pressure at the edges of the flexible package 1, such as illustrated by arrows A in FIG. 9A. Depending on the magnitude of the mechanical pressure on the expansion plates 9, 10, the dosage membrane 11 will be stretched or opened to a lesser or greater degree, causing the holes or incisions 14 to also be subjected to the stretching or opening, such as explained above, and as illustrated in FIGS. 2A and 2B.

As described above, the dosage membrane 11 is welded to an outer face of the expansion plates 9, 10 over the total length of the expansion plates 9, 10 by the weld 13. Moreover, according to this embodiment of the present invention, there is arranged one set of resilient stiffening plates 23, 24, wherein the dosage membrane 11 is welded to an outer face of the stiffening plates 23, 24 over the total length of the stiffening plates 23, 24, with the weld 17. The welds 13 and 17 may be made as a continuous weld over the total length of expansion plates 9, 10 and/or stiffening plates 23, 24, or they may also be made as a number of spot welds, partial welds of a certain length, etc.

Moreover, the stiffening plates 23, 24 are welded to an inner face of each of the external layers 2, 3, by the weld 25. In addition, the short ends 12 of the dosage device 8 and the stiffening plates 23, 24 are also welded to the two external layers 2, 3 by the joint 4. In certain cases, the weld connections 17 and 25 may be combined by a weld. In such a case, the weld 25 can be dropped, and weld 17 forms a connection from the inner face of the external layers 2, 3, through the dosage membrane 11 and the stiffening plates 23, 24.

Further, the dosage membrane 11 is completely or partly perforated with at least one longitudinal incision 26. The incision is substantially parallel to and in the area between the welds 13 and 17, in a distance from the through-going or partly through-going (almost through-going) incisions (i.e., slit-shaped through-holes or recesses) 14. The perforation of the dosage membrane 11 may be performed with mechanical cutting, laser, etc.

By the above described embodiment of the dosage device 8 with the at least one perforated incision 26 in the dosage membrane 11, and the set of the resilient stiffening plates 23, 24, the at least one incision 26 will be expanded to a hole when the dosage membrane 11 at one side is stretched, by moving the expansion plates 9, 10 a distance in relation to one of the stiffening plates 23, 24 connected to one of the side walls 2, 3. Such a distance may for example be provided by applying a mechanical pressure onto the flexible package 1, as shown by arrows A in FIG. 9A.

The size of the hole created from the at least one incision 26 may partly be varied by the choice of length of the at least one perforated incision 26, and by the magnitude of the mechanical pressure applied to the flexible package 1 externally. The at least one incision 26 may also be placed asymmetrical at the dosage membrane 11 in relation to the symmetry line A-A in FIG. 9A for the flexible package 1.

When the dosage device 8 is used to dosage or sprinkle the product through the perforated incisions 14 in the dosage membrane 11, there is no tension in the at least one incision 26, and the product held in the flexible package 1 cannot "pour" out between the expansion plates 9, 10 and the stiffening plates 23,24.

Figure 9C:
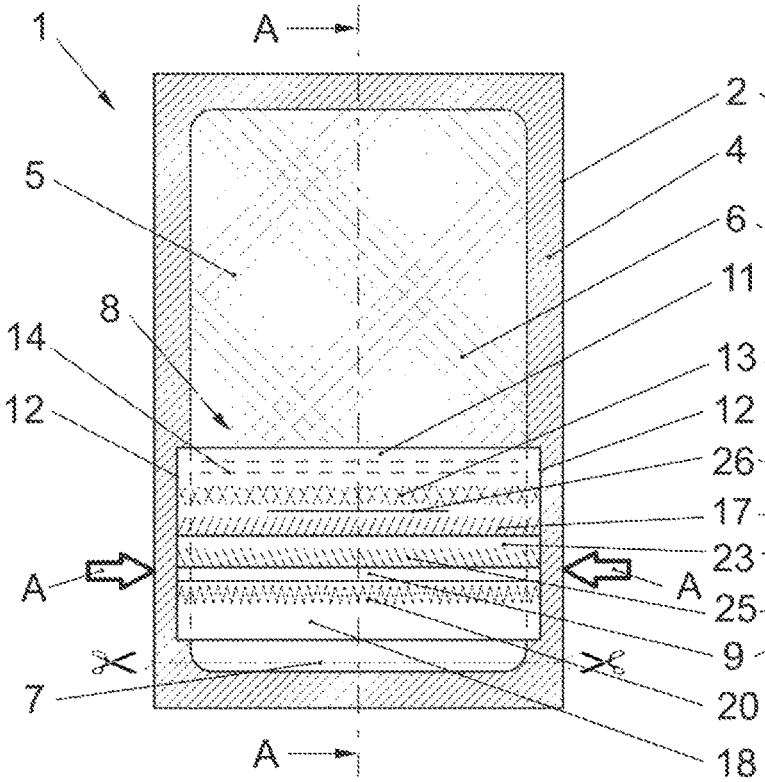
Figure 9D:
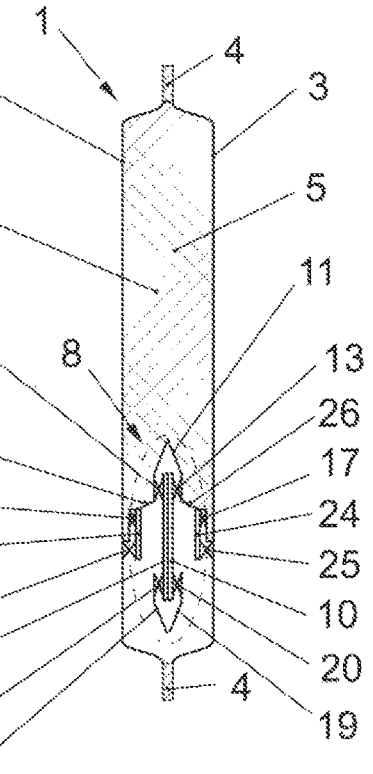

In FIGS. 9C, 9D, an alternative embodiment of the flexible package 1 is shown, illustrated in FIGS. 9A, 9B, and only the differences existing between the embodiments shall be described, for simplicity reasons.

In this alternative embodiment, the flexible package 1 can be provided in the same way as described in relation to the embodiment shown in FIGS. 9A and 9B, i.e., in relation to the joining 4 of the layers 2, 3, the creation of the closed volume 5, as well as the tear or perforated area 7. Above the weakened tear or perforated area 7, there is arranged a dosage device 8.

However, in this alternative embodiment, the dosage device 8 will be differently designed, in that the dosage device 8 comprises two expansion plates 9, 10, a dosage membrane 11, and two closing plates 18, 19. The expansion plates 9, 10 are, as described in relation to FIGS. 1A and 1B, joined at each of their short ends 12 in a suitable way so as to form a hinge or resilient function in the dosage device 8. Moreover, the dosage membrane 11 is, by a weld, connected to the expansion plates 9, 10 to an outer face of the expansion plates 9, 10.

The welding of the dosage membrane 11 and the expansion plates 9, 10 may be performed as a continuous weld over the total length of the expansion plates, or it may also be made as a number of spot welds, partial welds of a certain length, etc.

To provide a tight closing of the package 1 and the dosage device 8, the closing plates 18, 19 are connected to an outer face of the expansion plates 9, 10 over the entire length of the expansion plates 9, 10, through a weld 20. The weld 20 is arranged at an opposite end of the weld 13. Moreover, the closing plates 18, 19, as shown in FIG. 9C, are connected to the package 1 through the joint 4.

The dosage membrane 11 is made from a relatively elastic material or a film, wherein the dosage membrane 11 is perforated by a number of through-going incisions (through-holes) 14, at least over part of its width and length. The through-going or partly through-going (almost through-going) incisions 14 may for example be arranged in rows, as illustrated in FIG. 2.

The closing plates 18, 19 are produced from a thin, but relatively elastic, plastic material (e.g., an elastomer), and are designed particularly to achieve the best possible closing properties. It is also contemplated that the closing plates 9, 10 are integrated as a part of the expansion plates 9, 10, for example by plastic molding. The closing plates 18, 19 may further be formed with one or more lips or other designs to obtain the best possible closing properties.

After opening the flexible package 1, i.e., after having torn or cut away the weakened tear or perforated area 7, the product held in the flexible package 1 may be poured/delivered by applying a mechanical pressure onto the edges of the flexible package 1, as shown with arrows A in FIG. 9C. Depending on the magnitude of the mechanical pressure applied onto the expansion plates 9, 10, the dosage membrane 11 will be stretched or strained to a higher or lesser degree, causing the through-going incisions 14 to be subjected to this stretching or strain, e.g., such as illustrated in FIGS. 2A and 2B.

Further, according to this embodiment of the present invention, a set of resilient stiffening plates 23, 24 are arranged so that the dosage membrane 11 is welded to an outer face of the stiffening plates 23, 24 along the total length of the stiffening plates 23, 24 by the weld 17. The welds 13 and 17 may be made as a continuous weld over the total length of the expansion plates 9, 10 and/or stiffening plates 23, 24, or they may also be made as a number of spot welds, partial welds of a certain length, etc.

Moreover, the stiffening plates 23, 24 are welded to an inner face of each of the external layers 2, 3 by the weld 25. In addition, the short ends 12 of the dosage device 8 and the stiffening plates 23, 24 are also welded to the two external layers 2, 3 by the joint 4. In some cases, the weld connection 17 and 25 may be combined into one weld. In such a case, the weld 25 can be dropped, and weld 17 forms a connection from the inner face of the external layers 2, 3 through the dosage membrane 11 and to the stiffening plates 23, 24.

The dosage membrane 11 is further completely or partly perforated with a longitudinal incision 26, and the incision is placed substantially in parallel with, and in the area between, the welds 13 and 17. The perforation of the dosage membrane 11 may be performed by mechanical cutting, laser, etc.

By the above described embodiment of the dosage device 8 with the perforated incision 26 in the dosage membrane 11, and the set of resilient stiffening plates 23, 24, the incision 26 will expand into a hole when the dosage membrane 11 at one side is stretched by moving the expansion plates 9, 10 in a distance in relation to the stiffening plates 23, 24, which are connected to one of the side walls 2, 3. Such a distance may, for example, be provided by applying a mechanical pressure onto the flexible package 1, as illustrated by arrows A in FIG. 9A.

The size of the hole formed by the incision 26 may be varied partly by the selected length of the perforated incision 26, and by the magnitude of the mechanical pressure applied externally to the flexible package 1. The incision 26 may also be placed asymmetrically onto the dosage membrane 11 in relation to the symmetry line A-A in FIG. 9A for the flexible package 1.

When the dosage device 8 is used to administer or sprinkle the product through the perforated incisions 14 of the dosage membrane 11, there is no tension applied to the incision 26, and the product held in the flexible package 1 cannot "pour" out between the expansion plates 9, 10 and the stiffening plates 23, 24.

Figure 10A:
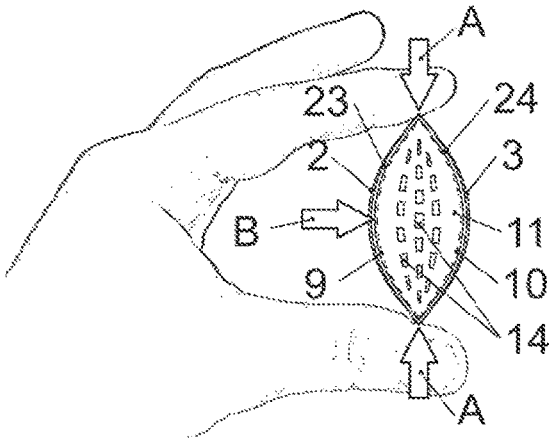
Figure 10B:
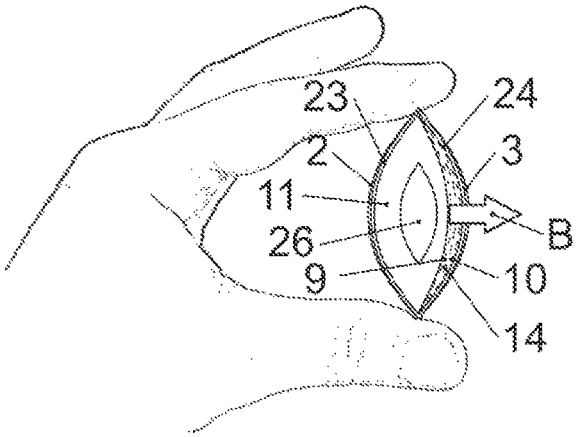

In FIGS. 10A and 10B, there is shown how to provide a partly open package in the flexible package 1, which is described in relation to FIGS. 9A-9D. Firstly, the user will then press the expansion plates 9, 10 of the dosage device 8 together, as shown by arrows A, and then transversely push or shove one of the expansion plates 9, 10, as shown by arrow B, against the other one of the expansion plates 10, 9. Due to the properties of the expansion plates 9, 10, the expansion plate 9 will flip over towards the other expansion plate 10, and the dosage membrane 11, which is welded to the expansion plate 9, 10, will attempt to follow the movement of the expansion plate 9.

Because also the dosage membrane 11 is welded to the outer face of the stiffening plates 23, 24, the dosage membrane 11 will be stretched and an opening in the incision 26 will be provided. Thus, an opening in the flexible package 1 is formed, as shown in FIG. 10B, such that the product held in the flexible package 1 may be poured out. The size of the opening is decided by the length of the at least one incision 26, and how much the expansion plates 9, 10 of the dosage device 8 are pushed together.

In FIG. 10B it is shown that the expansion plate 9 and the dosage membrane 11 have flipped over towards the expansion plate 10, whereby the at least one incision 26 in the dosage membrane 11 is stretched to widen into an opening, such that the contents of the flexible package 1 may be poured out.

It is to be understood that according to the embodiments described in relation to FIGS. 9A-9D it is also possible to provide two separate, distinct incisions 26, arranged on each side of section A-A, out towards the side edges of the flexible package 1. The incisions 26 may have different sizes, such that the user himself/herself may choose if a lesser or greater pouring of the product held in the flexible package 1 is desired. A person skilled in the art will also understand that the at least one incision may be provided in different ways. For example, the elastic dosage membrane 11 may be produced from two membrane parts arranged edge-to-edge, or with some overlap on each other, and then the membrane parts are welded together over parts of the adjacent edges/overlapping parts. The areas not welded together will then form one or more incisions 26 in the elastic dosage membrane 11.

Figure 11A:
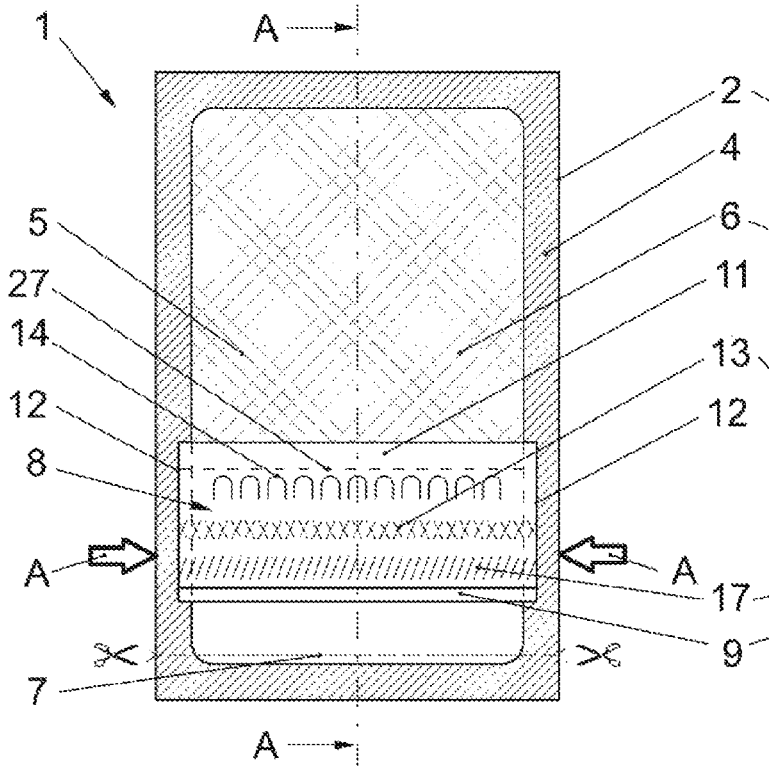
Figure 11B:
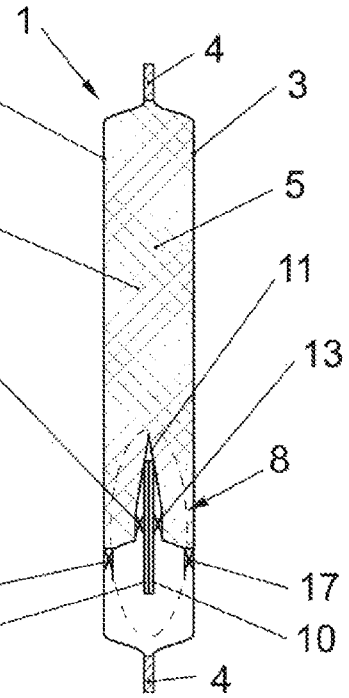

FIGS. 11A-11B show an additional embodiment of a package 1 of a flexible material according to the present invention, in which FIG. 11A shows the flexible package 1 seen from ahead (front), and FIG. 11B shows a cross section through the flexible package 1 from the side, through the section A-A shown in FIG. 11A.

The flexible package 1 comprises two external layers 2, 3 arranged above each other and then joined by joint 4 around their outer edges, so as to form a closed volume 5 in the flexible package 1, which closed volume 5 is partly or completely filled with a product.

Towards an end of the flexible package 1 there is provided a weakened tear or perforated area 7, substantially extending transverse to the width of the flexible package 1, when seen from ahead (front), so as to provide an opening mechanism in the flexible package 1 before use.

Above the weakened tear or perforated area 7 there is arranged a dosage device 8, which dosage device 8 comprises two expansion plates 9, 10 and a dosage membrane 11. The expansion plates 9, 10 are in a suitable way coupled or connected in each of their short ends 12, for such to form a "hinge or resilient function" in the dosage device 8.

In this way, the expansion plates 9, 10, when a user presses the connected short ends 12 of the expansion plates 9, 10 against each other, such as shown by arrows A, will be pressed away from each other, for such to provide an opening between them (see, also FIGS. 2A and 2B), wherein the size of the opening will vary depending on the magnitude of the mechanical pressure on the short ends 12. When the user releases the pressure, the expansion plates 9, 10 will resume their initial position, in which initial position the expansion plates 9, 10 substantially are in contact with each other over their entire length.

Then, the dosage membrane 11 will be welded to each of the expansion plates 9, 10 over the complete length of the expansion plates 9, 10, on an outer face of the expansion plates 9, 10, by the weld 13. The dosage membrane 11 is also welded to an inner face of each of the external layers 2, 3, by the weld 17. In addition, the short ends 12 of the dosage device 8 will also be welded to the two external layers 2, 3 through the fusion 4. In this way, the expansion plates 9, 10 the dosage membrane 11, and the fusion 4 will form a closed and tight delimitation of the closed volume 5 in the flexible package 1 when the expansion plates 9, 10 are not subjected to a mechanical pressure or tension. The expansion plates 9, 10 may in certain cases also be contemplated to constitute a part of the weld 17. In such a case the weld 17 will form a connection from the inner side of the external layers 2, 3, through the dosage membrane 11, and to the expansion plates 9, 10.

The weld 13 between the dosage membrane 11 and the expansion plates 9, 10 may be made as a continuous weld over the complete length of the expansion plates, or it may be also be made as a number of spot welds/partial welds of a certain length, etc.

The expansion plates 9, 10 are constituted by a thin, but relatively rigid plastic plate, which will also possess resilient properties.

The dosage membrane 11 is produced from a relatively elastic material or a film, wherein the dosage membrane 11 is perforated with a number of through-going incisions 14, at least over part of its width and length, wherein the through-going incisions 14 are curved shaped.

The incisions 14 may also be formed as "almost through-going" (i.e., recesses), whereby they will be torn open the first time the dosage device 11 is stretched.

As shown in the figures, the length of the expansion plates 9, 10 and the dosage membrane 11 will substantially correspond to at least the width of the closed volume 5 in the flexible package 1, seen from ahead, such that the expansion plates 9, 10 and the dosage membrane 11 will be connected to the external layers 2, 3 also through the joint 4.

After opening the flexible package 1, i.e., after tearing open or cutting away the weakened tear or perforated area 7, the product contained in the flexible package 1 may be poured out by applying a mechanical pressure onto the edges of the flexible package 1, such as shown with arrows A in FIG. 11A. Depending on the magnitude of the mechanical pressure on the flexible package 1 and the expansion plates 9, 10, the dosage membrane 11 will, because of the opening provided between the expansion plates 9, 10, be stretched or tensioned to a higher or lesser degree, and this causes also the through-going incisions 14 to be subjected to the same stretching or tensioning.

In this embodiment, the through-going incisions 14 are arranged just below an upper edge 27 of the expansion plates 9, 10. This means that, prior to the expansion plates 9, 10 being pressed away from each other, the through-going incisions 14 will be subjected to no tension and with a light pressure against the expansion plates 9, 10, and consequently, a very good sealing between the dosage membrane 11 and the walls of the expansion plates 9, 10 is obtained.

When the expansion plates 9, 10 are pressed away from each other, the dosage membrane 11 is stretched, and the incisions 14 are stretched and "pulled" over the edge 27, such that the holes or the incisions 14 (as previously shown in FIGS. 2A and 2B) appear. The size of the holes or incisions 14 depends on how much the dosage membrane 11 is stretched.

When the expansion plates 9, 10 return to the not tensioned initial position the dosage membrane slides back over the edge 27, the holes or incisions 14 close and are arranged with a slight pressure against the outer side of the expansion plates 9, 10.

In this embodiment, previously described closing plates 18, 19 are not necessarily used. However, in certain cases it may be suitable to use the closing plates 18, 19 as extra security.

Figure 12A:
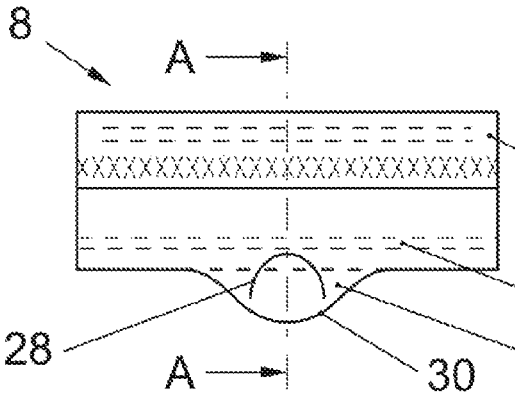
Figure 12B:
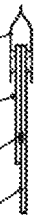
Figure 12C:
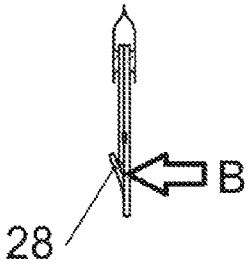

FIGS. 12A-12C show an embodiment of the dosage device 8 which is modified to comprise a closing mechanism, wherein FIG. 12A shows the dosage device 8 with a closing mechanism seen from ahead (the front), and FIGS. 12B and 12C show a cross section through the dosage device 8 with a closing mechanism from the side, through section A-A shown in FIG. 12A.

In such an embodiment, the dosage device 8 will comprise two expansion plates 9, 10, a dosage membrane 11, and the closing mechanism with a locking device 28.

The closing mechanism shown in FIGS. 12A-12C may in one embodiment be formed as a curve shaped through-going incision (through-hole) 28, in which the curve shaped, through-going incision 28 forms a locking device at one end of the expansion plates 9, and one of the expansion plates 9 is then formed with an extension (i.e., protrusion) 30. When the resilient expansion plates 9, 10 return to the initial position without tension, the curve formed "flap", which is formed by the curve formed through-going incision 28, is flipped over the edge of the expansion plate 10. Thus, the flap will squeeze the two expansion plates 9, 10 together. To release the two expansion plates 9, 10 from each other, the curve shaped "flap" is flipped back.

A person skilled in the art will understand that the closing mechanism shown in FIG. 12A-12C may also be achieved with other designs and cutting of the two expansion plates 9, 10.

To improve the sealing between the two expansion plates 9, 10 in the position without tension even more, the inner face of the expansion plates 9, 10 may be coated with a sealing ribbon 29 in one or more strips. The sealing ribbon 29 may for instance be comprised of a thin, soft plastic coating, applied in the form of a tape, or as a thin strain of glue. The sealing ribbon 29 may have different design on one of the expansion plates compared to the other, or may be applied only on one of the two expansion plates 9, 10.

Moreover, a person skilled in the art will understand that a zip-lock may be used with all the described embodiments of the flexible package according to the present invention, as an extra security. Then, the zip-lock will be arranged within the weakened tear or perforated area 7. The skilled artisan will know how to perform this, and thus, this is not described further herein.

The present invention has now been disclosed by means of several non-limiting embodiments. However, a person skilled in the art will understand that several modifications and variations may be made in the described flexible package within the scope of protection as defined by the claims.

The invention claimed is:

1. A package comprising:

at least two layers of a flexible material joined together to form a closed volume therebetween to contain a product, and a dosage device arranged on an inner face of the at least two layers of the flexible material, the dosage device including an elastic dosage membrane having a plurality of incisions arranged over at least a part of a width and a length of the elastic dosage membrane, wherein the dosage device further includes an opening device configured to stretch the elastic dosage membrane to open the incisions for pouring the product therein only upon mechanical compression of the opening device, and to automatically close the incisions and the package upon release of the mechanical compression of the opening device.

2. The package according to claim 1, wherein the opening device comprises at least two resilient expansion plates.

3. The package according to claim 2, wherein short ends of the expansion plates are coupled or connected to each other.

4. The package according to claim 2, wherein an inner face of the elastic dosage membrane is welded to an outer face of the expansion plates, and an outer face of the elastic dosage membrane is welded to the inner face of the at least two layers of the flexible material.

5. The package according to claim 2, wherein the expansion plates and the elastic dosage membrane are welded to the at least two layers of the flexible material through a weld seam.

6. The package according to claim 2, wherein the expansion plates have a plurality of hinges.

7. The package according to claim 1, wherein the dosage device further includes at least two closing plates.

8. The package according to claim 1, wherein a weakened tear or perforated area is arranged at an end of the at least two layers of the flexible material joined together.

9. The package according to claim 1, wherein the incisions are through-holes or recesses.

10. The package according to claim 1, wherein the elastic dosage membrane is manufactured from an elastic plastic film.

11. The package according to claim 1, wherein the inner face of the at least two layers of the flexible material includes at least two sealing plates, each one of the at least two sealing plates is arranged on the inner face of a respective one of the at least two layers of the flexible material, and each one of the at least two sealing plates is welded to the respective one of the at least two layers of the flexible material through a weld seam.

12. The package according to claim 11, wherein each one of the at least two sealing plates is arranged to abut an outer face of the elastic dosage membrane.

13. The package according to claim 11, wherein each one of the at least two sealing plates is manufactured from a resilient or elastic material.

14. The package according to claim 11, wherein each one of the at least two sealing plates extends over a total length of the dosage device.

15. The package according to claim 1, wherein the incisions have the same or different sizes and/or design.

16. The package according to claim 1, wherein the incisions are each formed as a cross, as a recess, or as a circular or oval shaped incision.

17. The package according to claim 1, further comprising two gripping devices attached to respective outer surfaces of the at least two layers of the flexible material.

18. The package according to claim 1, wherein the elastic dosage membrane further includes a completely or partially perforated longitudinal incision, the longitudinal incision being arranged at a distance from the incisions.

19. The package according to claim 1, wherein the dosage device further includes a set of resilient stiffening plates.

20. The package according to claim 2, wherein at least one of the expansion plates has a protrusion, the protrusion having at least one incision formed as a through-hole.

21. The package according to claim 1, wherein each of the plurality of incisions has a curved shape.

* * * * *